US008413671B2

(12) United States Patent
Li

(10) Patent No.: US 8,413,671 B2
(45) Date of Patent: Apr. 9, 2013

(54) INTELLIGENCE OUTDOOR SHADING ARRANGEMENT

(75) Inventor: Wanda Ying Li, Irvine, CA (US)

(73) Assignee: Oliver Joen-An MA, Arcadia, CA (US)

( * ) Notice: Subject to any disclaimer, the term of this patent is extended or adjusted under 35 U.S.C. 154(b) by 0 days.

(21) Appl. No.: 12/802,550

(22) Filed: Jun. 8, 2010

(65) Prior Publication Data

US 2010/0245032 A1 Sep. 30, 2010

Related U.S. Application Data

(63) Continuation-in-part of application No. 12/315,120, filed on Nov. 28, 2008.

(51) Int. Cl.
*E04H 15/02* (2006.01)

(52) U.S. Cl.
USPC ..... 135/96; 135/16

(58) Field of Classification Search ..... 135/16, 135/20.3, 96
See application file for complete search history.

(56) References Cited

U.S. PATENT DOCUMENTS 2,960,094 A * 11/1960 Small ..... 135/22
7,128,076 B2 * 10/2006 Freedman ..... 135/20.3
2005/0016571 A1 * 1/2005 Wu ..... 135/20.1
2005/0072451 A1 * 4/2005 Vivian et al. ..... 135/16
2006/0124122 A1 * 6/2006 Young et al. ..... 126/573
2009/0277486 A1 * 11/2009 Stepaniuk et al. ..... 135/88.01
2009/0314319 A1 * 12/2009 Young et al. ..... 135/16
2009/0320827 A1 * 12/2009 Thompson et al. ..... 126/576
2010/0012164 A1 * 1/2010 Stoelinga ..... 135/20.3

* cited by examiner

*Primary Examiner* — Noah Chandler Hawk
(74) *Attorney, Agent, or Firm* — Raymond Y. Chan; David and Raymond Patent Firm

(57) ABSTRACT

An intelligence outdoor shading arrangement includes an outdoor shading system, an environmental sensor device and a functional controller. The outdoor shading system includes at least an outdoor shading device including a supporting frame, a power source, an awning frame suspendedly and movably supported by the supporting frame, and a shelter mounted to the awning frame to define a shading area under the shelter. The environmental sensor device is electrically linked to the power source and is installed to the outdoor shading system for detecting an environmental change of the shading system in responsive to the shading area thereof. The functional controller is electrically linked to the environmental sensor device and is operatively controlled the awning frame of the outdoor shading system, wherein when the functional controller receives a command signal from the environmental sensor device, the awning frame is automatically adjusted to regulate the shading area thereof in responsive to the environmental change of the outdoor shading system.

11 Claims, 14 Drawing Sheets

INTELLIGENCE OUTDOOR SHADING ARRANGEMENT

CROSS REFERENCE OF RELATED APPLICATION

This is a Continuation-In-Part application that claims the benefit of priority under 35 U.S.C. §119 to a non-provisional application, application Ser. No. 12/315,120, filed Nov. 28, 2008.

BACKGROUND OF THE PRESENT INVENTION

1. Field of Invention

The present invention relates to a shading device, and more particularly to an intelligence outdoor shading arrangement comprising a shading system and a functional controller for adjusting the shading system to optimally respond to the environmental condition in which the shading device operates.

2. Description of Related Arts

A conventional shading device, such as a convention outdoor umbrella, usually comprises a supporting frame and a sun shading system mounted by the supporting frame to define a predetermined shading area under the sun shading system. Over the years, there have been extensive developments for improving the quality and functions of such a conventional shading device. For example, an outdoor umbrella may be equipped with a solar energy collection arrangement and a lighting system for providing environmentally friendly illumination for the relevant users. Moreover, a conventional gazebo may be equipped with a specially designed ventilation system so that users of the gazebo have adequate access to fresh air when they are gathering within the gazebo while preserving their privacy.

Notwithstanding these developments, conventional shading devices, even with some sophisticated improvements, such as the above mentioned lighting system and the ventilation system, are usually not responsive enough to the change of environmental circumstances in which the shading devices operate. This discrepancy may be partially resolved by manual operation of the shading devices. For example, a user may easily turn on or turn off the illumination system whenever necessary. In some situations, however, frequent manual operation of the sun shading system may mean inconvenience and interruption of a scheduled activity in the sun shading system. A good example is that when a user utilizes an outdoor umbrella in a very sunny environment, he or she may need to adjust the angle of inclination of the awning fabric in order it to provide an optimal sun shading effect. However, as time goes by, the angle of inclination of the awning fabric may need adjustment because of the change of position of the sun throughout the day. As a result, in order to keep the same standard of sun shading quality of the sun shading system, the user may have to manually adjust the angle of inclination of the awning fabric so that the angle of inclination always corresponds with the sun position. This imparts extreme inconvenience on the part of the user or the one who is responsible for adjusting the angle of the awning fabric.

Outdoor shading devices are usually provided in a campground, on a beach, or in the back yard of the house to give a pleasant shade for a user under the sun. Usually, the user uses the outdoor shading device especially on a sunny day to prevent the sunlight directly projecting on the user, or rainy day to prevent the user being soaked. The outdoor shading devices are also commonly provided at outdoor seating area of a restaurant, so that the customer is able to enjoy the meal in the outdoor atmosphere under the shading device.

A conventional shading device, such as a conventional outdoor umbrella, generally comprises a supporting frame and a shading system supported by the supporting frame to define the predetermined shading area under the shading system. Over the years, there have been extensive developments for improving the quality and functions of such conventional shading device. For example, an outdoor umbrella may be equipped with a solar energy collection arrangement and a lighting system for providing environmental friendly illumination for the relevant users. Moreover, another shading device, such as a conventional gazebo, may be equipped with a specially designed ventilation system so that users of the gazebo have adequate access to fresh air when they are gathering within the gazebo while preserving their privacy.

Notwithstanding these developments, conventional shading devices, even with some sophisticated improvements, such as the above mentioned lighting system and the ventilation system, are usually not responsive enough to the change of environmental circumstances in which the shading devices operate. This discrepancy may be partially resolved by manual operation of the shading devices. For example, a user may easily turn on or turn off the illumination system whenever necessary. In some situations, however, frequent manual operation of the shading system may mean inconvenience and interruption of a scheduled activity in the shading system.

A good example is that when a user utilizes an outdoor umbrella in a very sunny environment, he or she may need to adjust the angle of inclination of the awning frame in relation to the sun light projecting angle, so as to provide an optimal sun shading effect. However, as time goes by, the angle of inclination of the awning frame may need adjustment because of the change of position of the sun throughout the day. As a result, in order to keep the same standard of sun shading quality of the sun shading system, the user may have to manually adjust the angle of inclination of the awning frame so that the angle of inclination always corresponds with the sun position. This imparts extreme inconvenience on the part of the user or the one who is responsible for adjusting the angle of the awning frame.

Moreover, some places, such as restaurant outdoor seating area, may have a group of outdoor umbrellas as the outdoor shading devices. The servers of the restaurant may have to individually adjust each of the outdoor shading devices in order to provide the optimal shading effect for the customers. Therefore, it is exhausted that the servers of the restaurant have to independently adjust each of the shading devices every certain time period in order to provide the optimal shading effect for their customers. At the beginning or the end of the day, the servers may also have to unfold or fold each of the outdoor umbrellas manually.

SUMMARY OF THE PRESENT INVENTION

The invention is advantageous in that it provides an intelligence outdoor shading arrangement comprising a shading system and a functional controller for adjusting the shading system to optimally respond to the environmental condition where the shading device operates.

Another advantage of the invention is to provide an intelligence outdoor shading arrangement, wherein the remote control unit is able to remotely control one or more shading system and/or the functional controller for controllably and remotely control the intelligence outdoor shading arrangement.

Another advantage of the invention is to provide an intelligence outdoor shading arrangement, wherein the wind detector and/or the sun detector are able to simply install at the outdoor shading device in a wireless manner, so as to automatically adjust the shading device in responsive to the environmental conditions.

Another advantage of the invention is to provide an intelligence outdoor shading arrangement, wherein the wind detector is able to detect the horizontal, vertical and lateral movement of the awning frame or supporting frame of the shading device, such that when the movement is exceeded the preset threshold, wind detector is able to unfold the awning in order to protect the awning against the wind.

Another advantage of the invention is to provide an intelligence outdoor shading arrangement, wherein the sun detector is solar powered, wherein the sun detector is able to automatically fold the awning in the shading position according to the detected sun via the sun detector.

Another advantage of the invention is to provide an intelligence outdoor shading arrangement comprising an environmental sensor device and a functional controller for controlling the shading system in responsive to environmental change in the location where the intelligence outdoor shading arrangement operates. In other words, the functional controller automatically and optimally adjusts the settings of the shading system whenever necessary with minimal user's involvement.

Another advantage of the invention is to provide an intelligence outdoor shading arrangement which is capable of incorporating a wide variety of environmentally-related devices (such as an illumination system) as an automatic and self-adjustment system for ensuring that when the environment changes, the corresponding environmentally-related devices are activated or deactivated to cater for that environmental change without substantive human intervention.

Another advantage of the invention is to provide an intelligence outdoor shading arrangement comprising a shading system which is adapted to form as a wide variety of shading devices, such as outdoor umbrellas, canopy, gazebos etc., so as to facilitate widespread applications of the present invention.

Another advantage of the invention is to provide an intelligence outdoor shading arrangement, wherein a remote control system is able to centrally control a group of outdoor shading devices in a concurrent manner.

Another advantage of the invention is to provide an intelligence outdoor shading arrangement, wherein the remote control system is able to synchronously activate a group of outdoor shading devices via a central control unit.

Another advantage of the invention is to provide an intelligence outdoor shading arrangement, wherein the central control unit enables to activate the outdoor shading devices from a predetermined distance by wiring connection or wirelessly, so that it is unnecessary for a user to operate each of individual outdoor shading devices.

Another advantage of the invention is to provide an intelligence outdoor shading arrangement, wherein two or more outdoor shading devices are being synchronously operated between a folded and unfolded position at the same time.

Another advantage of the invention is to provide an intelligence outdoor shading arrangement, wherein the environmental sensing module of the remote control system enables the shading devices self-adjusted to provide an optimal shading area thereunder.

Another advantage of the invention is to provide an intelligence outdoor shading arrangement, wherein the personal preference setting allows the user adjustably controlling the shading devices based on their preferences.

Another advantage of the invention is to provide an intelligence outdoor shading arrangement, wherein a connecting arrangement is able to electrically linking two or more shading devices to the central control unit to form a shading device network for centrally controlling a group of shading devices.

Another advantage of the invention is to provide an intelligence outdoor shading arrangement, wherein a wireless linking module of the connecting arrangement is able to centrally control a group of shading devices in the wireless manner, so as to eliminate a pre-wiring process for electrically connecting the central control unit with the group of shading devices via wires.

According to the present invention, the foregoing and other objects and advantages are attained by providing an intelligence outdoor shading arrangement, comprising:

an outdoor shading system comprising at least an outdoor shading device which comprises a supporting frame, a power source, an awning frame suspendedly and movably supported by the supporting frame, and a shelter mounted to the awning frame to define a shading area under the shelter;

an environmental sensor device which is electrically linked to the power source for detecting an environmental change of the shading system in responsive to the shading area thereof; and a functional controller which is electrically linked to the environmental sensor device and is operatively controlled the awning frame of the shading device, wherein when the functional controller receives a command signal from the environmental sensor device, the awning frame is adjusted to regulate the shading area thereof in responsive to the environmental change of the shading system.

In one embodiment, the present invention provides a remote control system for controlling the outdoor shading system which comprises a group of outdoor shading devices, a central control unit for synchronously and remotely control each of the shading devices, and a connecting arrangement for electrically linking the central control unit to each of the shading devices so as to form a shading devices network.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
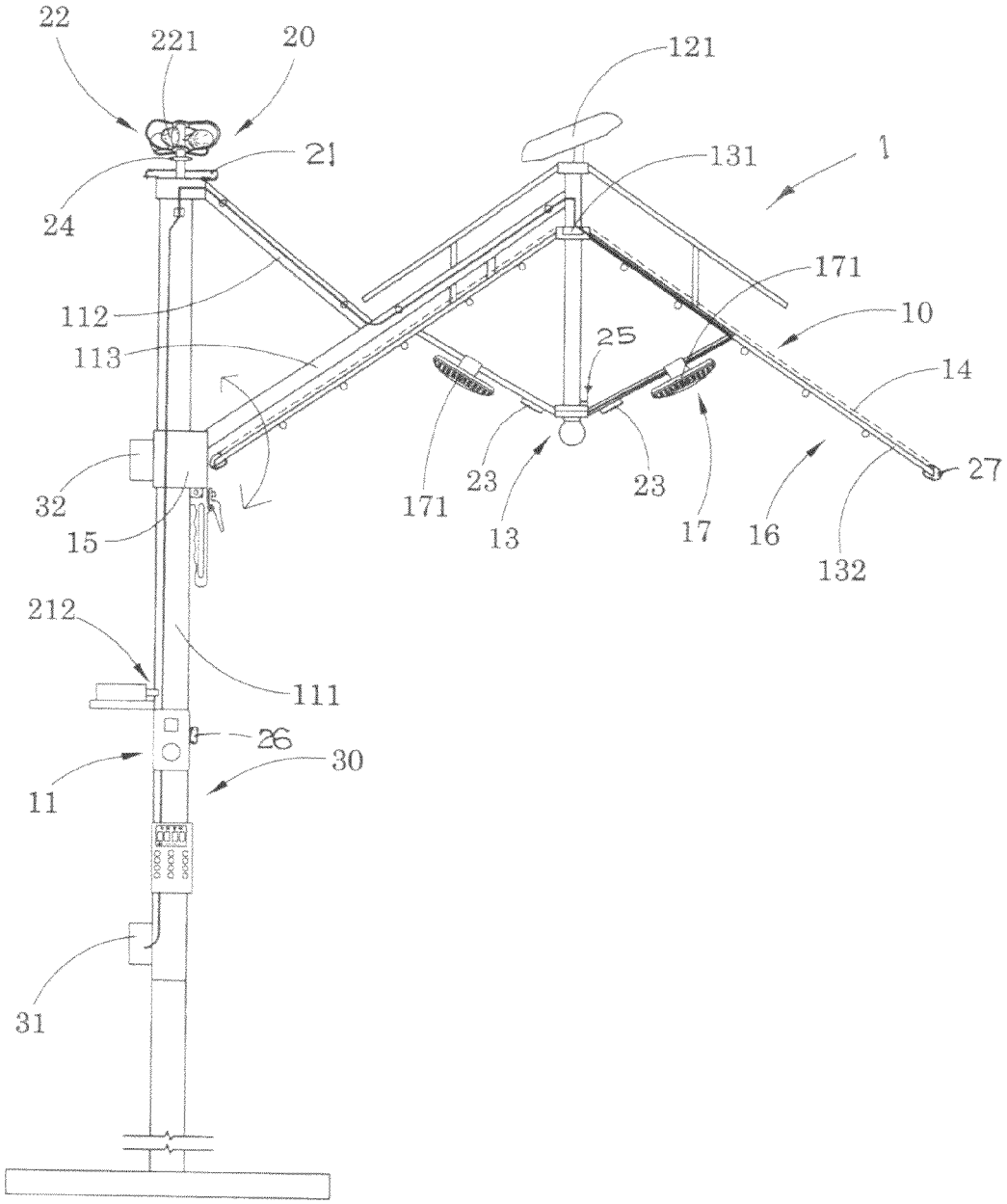
FIG. 1 is an elevation view of the intelligence outdoor shading arrangement according to a preferred embodiment of the present invention.
Figure 2:
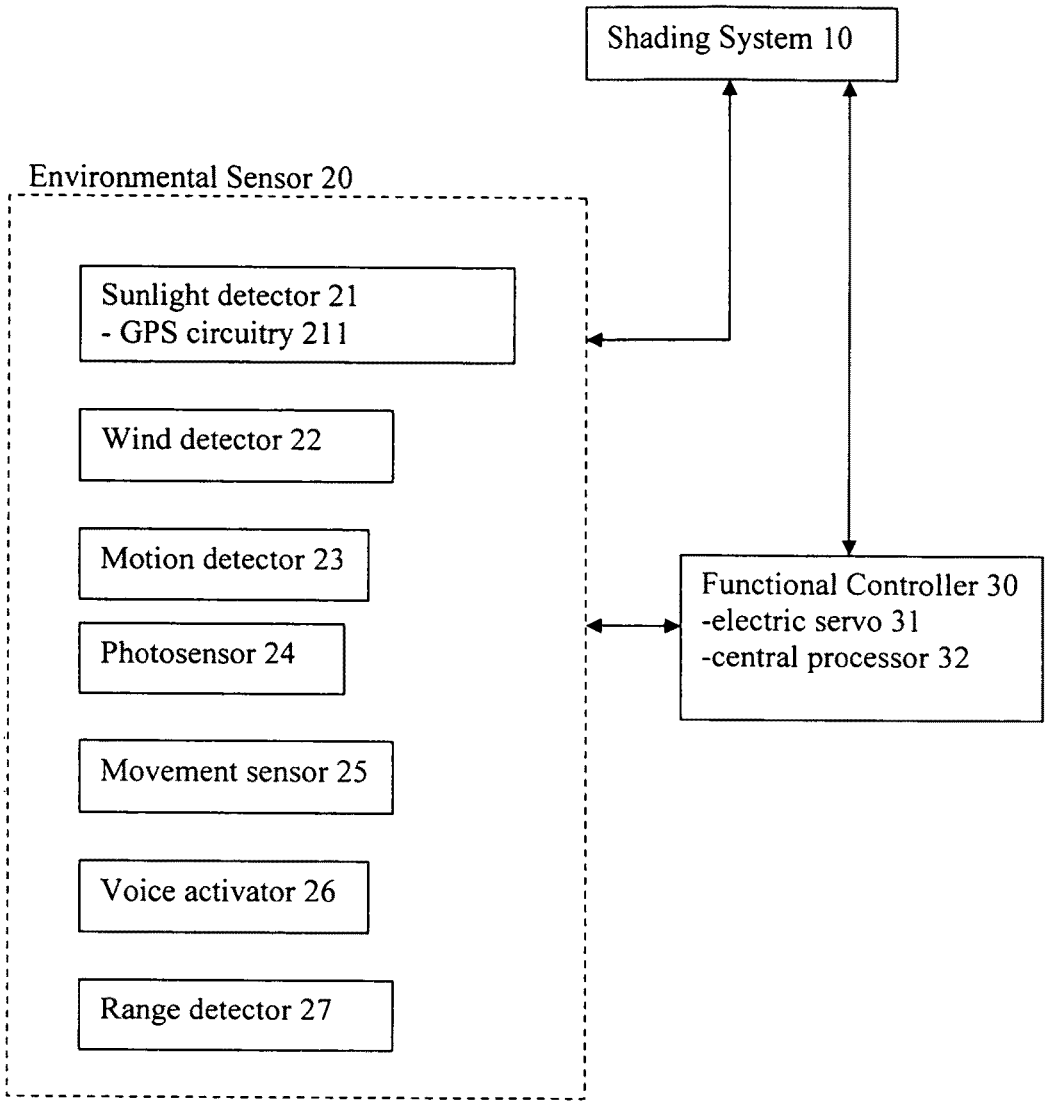
FIG. 2 is a schematic diagram of the intelligence outdoor shading arrangement according to the above preferred embodiment of the present invention.
Figure 3:
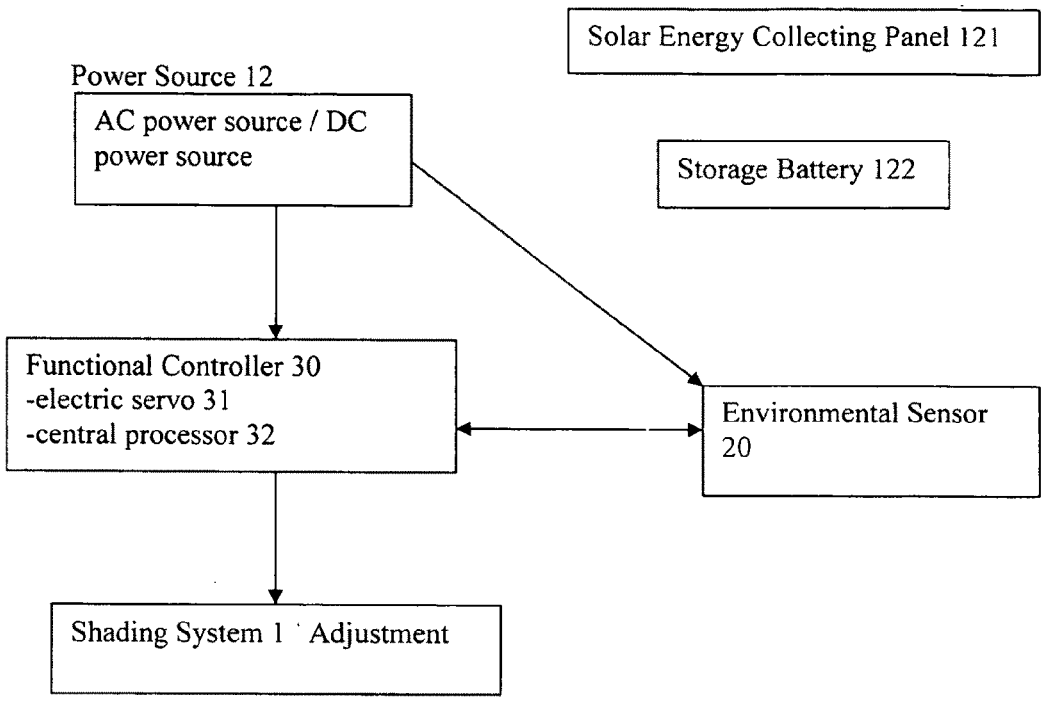
FIG. 3 is a schematic diagram of the intelligence outdoor shading arrangement according to the above preferred embodiment of the present invention, illustrating the operation of the power source.

Referring to FIG. 1 to FIG. 3 of the drawings, an intelligence outdoor shading arrangement, such as an outdoor umbrella, according to a preferred embodiment of the present invention is illustrated, in which the intelligence outdoor shading arrangement comprises an outdoor shading system 1, an environmental sensor device 20, and a functional controller 30.

The outdoor shading system 1 comprises at least an outdoor shading device 10 which comprises a supporting frame 11, a power source 12 supported at the supporting frame 11, an awning frame 13 suspendedly and movably supported by the supporting frame 11, and a shelter 14 mounted to the awning frame 13 to define a shading area under the shelter 14. In a preferred embodiment of the present embodiment, the power source 12 is an AC power supply connected with the wall socket. In an alternative embodiment, the power source 12 is a solar power supply. The power source provides 12V AC, 12V DC, and 5V DC for different electric elements.

The environmental sensor device 20 is electrically linked to the power source 12 and installed to the shading system 1 for detecting an environmental change of the shading system 1 in responsive to the shading area thereof.

The functional controller 30 is electrically linked to the environmental sensor device 20 and operatively controls the awning frame 13 of the shading device 10, wherein when the functional controller 30 receives a command signal from the environmental sensor device 20, the awning frame 13 is automatically adjusted to regulate the shading area thereof in responsive to the environmental change of the shading system 1.

According to the preferred embodiment of the present invention, the supporting frame 11 comprises a supporting post 111, a retention member 112, and a supporting member 113 supporting the supporting post 111 with the awning frame 13 in a movable manner. As shown in FIG. 1 of the drawings, the intelligence outdoor shading arrangement is embodied as an outdoor umbrella, yet one skill in the art should appreciate that the present invention can be embodied as a wide variety of shading devices, such as gazebo, canopy and the like. The awning frame 13 comprises an upper housing 131 supported by the retention member 112 and the supporting member 113, and a plurality of awning members 132 radially and foldably extended from the upper housing 131 to suspendedly support the shelter 14 on top of the awning members 132, wherein the awning frame 13 is capable of moving between a folded position and an unfolded position, wherein in the folded position, the awning members 132 are pivotally and inwardly folded to form a compact structure by the supporting frame 11, wherein when the awning frame 13 is in the unfolded position, the awning members 132 are pivotally and unfolded and radially extend from the upper housing 131 to suspendedly support the shelter 14. The shelter 14 comprises a shading fabric foldably attached onto the awning frame 13 for blocking sunlight from penetrating through the shelter 14.

Moreover, the shading device 10 further comprises an angular joint 15 coupling the awning frame 13 with the supporting frame 11, wherein the awning frame 13 is operatively controlled by the functional controller 30 to selectively adjust an orientation of the awning frame 13 through the angular joint 15 such that the shelter 14 is adjusted to face toward the direction of the sun for maximizing a shading effect of the shelter 14.

In a preferred embodiment of the present invention, the angular joint 15 is slidable along the supporting post 111, and can be selectively fixed on the supporting post 111. The angular joint 15 is also pivotally connected with the supporting member 113. Referring to FIG. 1, one end of the retention member 112 is pivotally connected with the top of the supporting post 111; the other end of the retention member 112 is pivotally connected with the middle portion of the supporting member 113. In this manner, when the angular joint 15 is sliding along the supporting post 111, the angle between the supporting post 111 and the supporting member 113 is changing accordingly. As a result, the facing direction of the shelter 14 is also changed. In this way a best shading effect of the shelter 14 can be adjusted regarding the direction of the sun shine.

Figure 4:
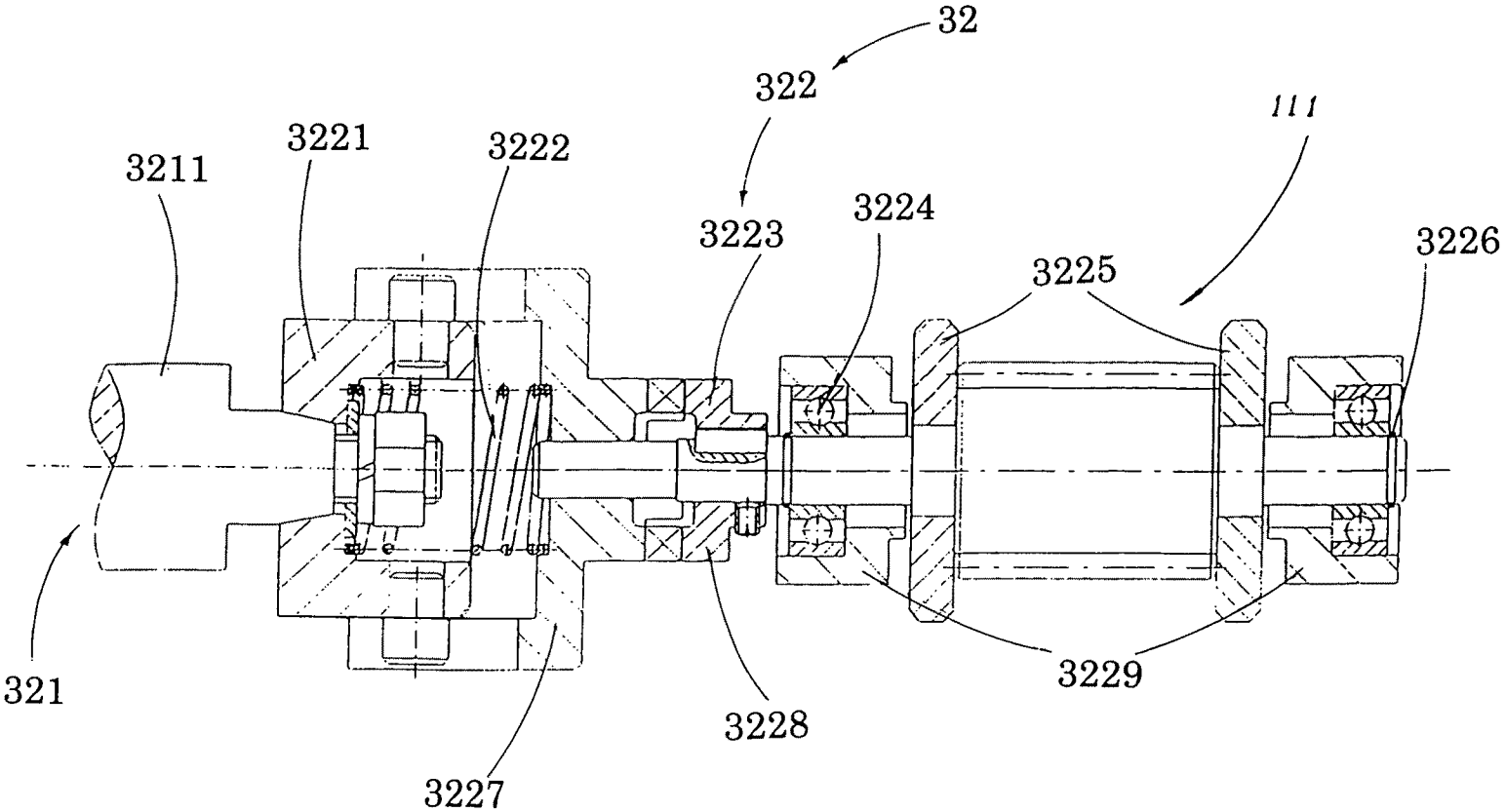
FIG. 4 is a sectional view of the structure of the direction electric servo installed on the supporting post for automatically control the facing direction of the awning frame.

It is worth mentioning, in a preferred embodiment of the present invention, the angular joint 15 is driven by an electric servo to realize automatic control. The functional controller 30 comprises a direction electric servo 32 which is electrically linked to the power source 12 and is operatively controlled by the functional controller 30 to automatically and selectively position and lock the angular joint 15. Referring to FIG. 4, the direction electric servo 32 comprises a servo motor 321 providing the driving power, a transmission arrangement 322 which transfer the power from the servo motor 321 to the angular joint 15. In the preferred embodiment, the servo motor 321 has a shaft 3211. The transmission arrangement 322 has a motor sleeve 3221, a reset spring 3222, a semi coupling 3223, a rolling bearing 3224, a roll guide 3225, a spring collar 3226, a clutch 3227, a coupling 3228, and a sliding handle 3229. In the preferred embodiment of the present invention, the servo motor is a DC motor working on 12V DC power supply, the output power is 50 W. The rotation of the motor is reduced and transferred to a linear movement by a worm gear. The transmission arrangement 322 is a rack-and-pinion structure. The rack is attached longitudinally along the supporting post 111, and the pinion is mechanically connected with the worm gear of the servo motor through a clutch. The angular joint 15 is mechanically connected with the servo motor and is driven by the motor to move along the supporting post 111 through the rack. By controlling the servo motor, the functional controller 30 can control the position of the angular joint 15, and consequently control the facing direction of the shelter 14.

Accordingly, the environmental sensor device 20 comprises a sunlight detector 21 provided on top of the shading device 10 such as mounted above the shelter 14 wherein, for example, according to the preferred embodiment, it is mounted on top of the supporting post 111. The sunlight detector 21 is electrically linked to the functional controller 30, such that when the sunlight detector 21 detects the direction of the sun, the shelter 14 and the awning frame 13 are adjusted to face towards the direction of the sun as activated by the functional controller 30. In order to precisely detect an orientation of the sunlight direction, the sunlight detector 21 comprises a GPS circuitry 211 electrically linked to the functional controller 30 for automatically tracking the direction of the sun. In other words, the sunlight information can be obtained through GPS signal received by the GPS circuitry 211, with the information of location and time, sunlight direction can be calculated. As a result, the sunlight detector 21 further comprises a GPS port 212 provided at the supporting frame 11 of the shading device 10 for operatively linked to a GSP device for automatically tracking the direction of the sun.

It is worth mentioning that the GPS device can be built-in to the supporting frame 11. Alternatively, it can be an external GPS device, such as a conventional GPS navigation system specifically programmed to receive sunlight information through satellite signal. In the latter case, the user is able to bring his or her own GPS device to conveniently connect with the GPS circuitry 211 through the GPS port 212 for obtaining the sunlight information.

Moreover, the environmental sensor device 20 further comprises a wind detector 22 is electrically linked to the functional controller 30, such that when the wind detector 22 detects the direction of the wind, the shelter 14 is adjusted through the angular joint 15 to minimize a wind loading on the shelter 14, or to close the shelter 14, so as to avoid the shading device 10 to be accidentally flipped over and causing personal injuries. According to the preferred embodiment, the wind detector 22 is preferred to be installed above the shelter 14 wherein, for example, it is installed on top of the supporting frame 11 (the supporting post 111 specifically). The wind detector 22 can be a conventional mechanical-type wind detector which is capable of detecting the velocity of the incoming wind so that it can transmit the corresponding signal to the functional controller 30 when adjustment of angle of inclination of the awning frame 13 is necessary. As shown in FIG. 1 of the drawings, the wind detector 22 comprises a rotation blade 221 rotatably supported at the supporting frame 11 for exposing to ambient wind, wherein when the rotation blade 221 is blown to rotate, the rotational speed is adapted to accurately reflect the speed of the incoming wind.

In order to enhance a utility feature of the present invention, the environmental sensor device 20 further comprises a motion detector 23 mounted to the outdoor shading device 10, wherein it can be embodied to be mounted at the supporting frame 11, and is electrically linked to the functional controller 30, such that when the motion detector 23 detects the presence of a user within a detection area, the shelter 14 is actuated to fold at the unfolded position.

On the other hand, the functional controller 30 comprises an electric servo 31 which is electrically linked to the power source 12 and is operatively controlled by the functional controller 30 to automatically and selectively actuate the awning frame 13 between an unfolded position that the shelter 14 is expanded to maximize the shading area thereof, and a folded position that the shelter 14 is folded up to minimize the shading area thereof. As a result, the electric servo 31 is electrically connected to the wind detector 22 and the motion detector 23 so that the awning frame 13 is capable of timely responding to the environmental change surrounding the intelligence outdoor shading arrangement.

Figure 5:
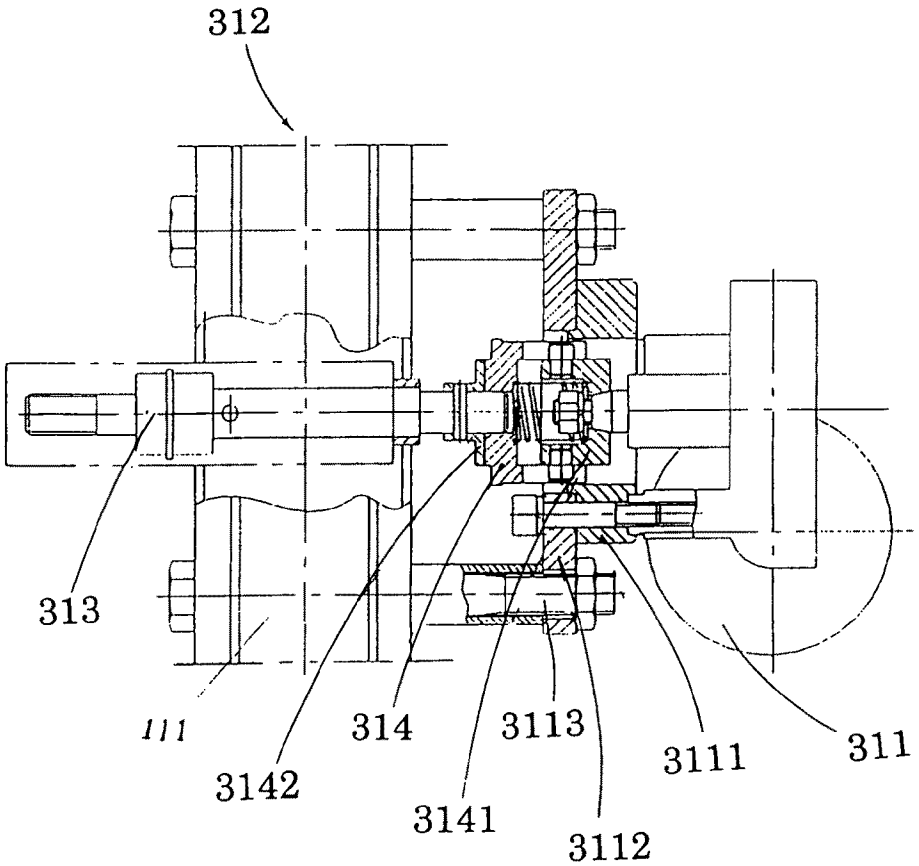
FIG. 5 is a sectional view of the structure of the direction electric servo installed on the supporting post for automatically fold and unfold the shelter.

Referring to FIG. 5, in a preferred embodiment of the present invention, the electric servo 31 comprises a DC motor 311 providing the driving power, a string arrangement 312 mechanically connected with the upper housing 131, a rolling axes 313 rolling the string arrangement 312, and a clutch 314 mechanically connected the DC motor 311 and the rolling axes 313 through a motor sleeve 3141 and a coupling 3142. The DC motor 311 is fixed in a motor seat 3111 which is attached on the supporting post 111 by a connecting board 3112 and screws 3113, and it works on 12V DC power supply, the output power is 50 W. The DC motor is controlled by the functional controller 30. When the DC motor is rotating in a predetermined direction, the rolling axes will roll the string arrangement and open the shelter 14 through the upper housing 131. When the DC motor is rotating in the opposite direction, the rolling axes will release the string arrangement and close the shelter 14 through the upper housing 131.

According to the preferred embodiment of the present invention, the shading system 10 further comprises a light module 16 supported at the awning frame 13 for illuminating the shading area, wherein the environmental sensor device 20 further comprises a photosensor 24 which is mounted at the supporting frame 11 and is electrically linked to the light module 16, such that when the photosensor 24 detects a light brightness of an environment of the shading system 10 being lower than a preset light level threshold, the light module 16 is activated for providing extra illumination to the shading area. Similarly, when the ambient brightness is above the threshold brightness level, the photosensor 24 is arranged to produce the corresponding signal so as to deactivate the light module 16. According to the preferred embodiment of the present invention, the light module 16 may comprise a conventional light bulb, or a plurality of LEDs for providing optimal illumination to the shading area.

The shading system 1 further comprises a sound module 17 which is electrically linked to the environmental sensor device 20. According to the preferred embodiment, the sound module 17 is embodied to be supported at the awning frame 13 for generating an audio effect within the shading area, wherein the environmental sensor device 20 comprises a movement sensor 25 detecting the awning frame 13 at the unfolded and folded positions, such that when the movement sensor 25 detects the awning frame 13 at the unfolded position, the sound module 17 is automatically activated for generating the audio effect, and when the movement sensor 25 detects the awning frame 13 at the folded position, the sound module 17 is automatically deactivated. The sound module 17 comprises at least one audio speaker 171 mounted onto the awning frame 13 and is electrically connected to the power source 12 for delivering audible sound to the shading area when the sound module 17 is activated.

In order to utilize an environmentally friendly power source as the power source 12 of the present invention, the power source 12 comprises at least one solar energy collecting panel 121 for collecting solar energy and converting the solar energy into electrical energy, and a storage battery 122 linked to the solar energy collecting panel 121 for storing the electrical energy to supply the functional controller 30 and the electrical components of the shading system 1, such as the light module 16 and the sound module 17. According to the preferred embodiment, the solar energy collecting panel 121 is supported above the awning frame 13 of each outdoor shading device 10.

On the other hand, the environmental sensor device 20 further comprises a voice activator 26 electrically linked to the sound module 17, such that when the voice activator 26 detects an audio command, the sound module 17 is activated for generating the audio effect. According to the preferred embodiment of the present invention, the sound module 17 is mounted at the supporting frame 11 of the outdoor shading device 10.

Moreover, the environmental sensor device 20 further comprises a range detector 27 electrically linked to the electric servo 31, such that when the range detector 27 detects the presence of a user within an awning folding range at the time the awning frame 13 is being folded to the unfolded position, the electric servo 31 is automatically deactivated to stop the awning frame 13 from being folded to the unfolded position or vice versa. According to the preferred embodiment, the range detector 27 is mounted at the awning frame 13 of the outdoor shading device 10.

In order to coordinate and control the various electrical and mechanical components mentioned above, the functional controller 30 further comprises a central processor 32 supported by the supporting frame 11 to electrically connect with the environmental sensor device 20 and the shading system 10. The central processor 32 can be an integrated circuit or a more sophisticated processor which is pre-programmed to coordinate the environmental sensor device 20 and to control the operation of the shading system 10. For example, it manages and controls the electricity supply and demand between the power source 12 and the various electrical components (such as the light module 16).

In order to monitor the operation of the intelligence outdoor shading arrangement, the environmental sensor device 20 may further comprise a monitoring display provided on the shading system 10 and is electrically connected with the central processor 32 for displaying the operational parameters of the intelligence outdoor shading arrangement in a real-time basis. For example, the monitoring display may illustrate the date, time, wind speeds and wind direction at a particular instance in which the shading device is utilized.

In summary, the present invention provides an intelligent manner to control an outdoor shading device automatically. The opening and closing of the shelter 14, and the facing direction of the awning frame 13 are all driven by motors. The functional controller can actuate the motor according to the information sensed by the sensors. All these can be achieve by predetermined program, or by user's setting.

In a preferred embodiment, the operation of the intelligent shading device is programmed. First, the timer is set. Then the wind speed level is set, so when the wind speed reaches this level, the shelter 14 will be automatically folded. Also, the time of opening and closing the shelter 14 can be set. The shelter 14 can be automatically unfolded and folded according to the time.

During the operation of the intelligence outdoor shading arrangement, when it is the time to open, the wind detector 22 will detect the wind speed, and the sunlight detector 21 will detect the sun light, wherein if in a predetermined period of time the wind speed is within the allowed level, and also the sun light is stronger than a predetermined level, the device will give a sound alarm to warn people around, and then open the shelter 14. The awning frame 13 and the shelter 14 will face the sun light for best efficiency. The wind detector 22 will detect the wind speed every 10 seconds, if the wind speed is larger than the predetermined level, the device will give a sound alarm to warn people around, and then fold up the awning frame 13 and the shelter 14. During the period the shelter 14 is open, the angular joint 15 keeps changing the facing direction of the awning frame 13 following the movement of the sun to provide best shading effect. When it is the time to close the shelter 14, the device will give a sound alarm to warn people around, and then close the awning frame 13 and the shelter 14. The device can also receive commands from a remote control or acoustic signals.

Figure 6:
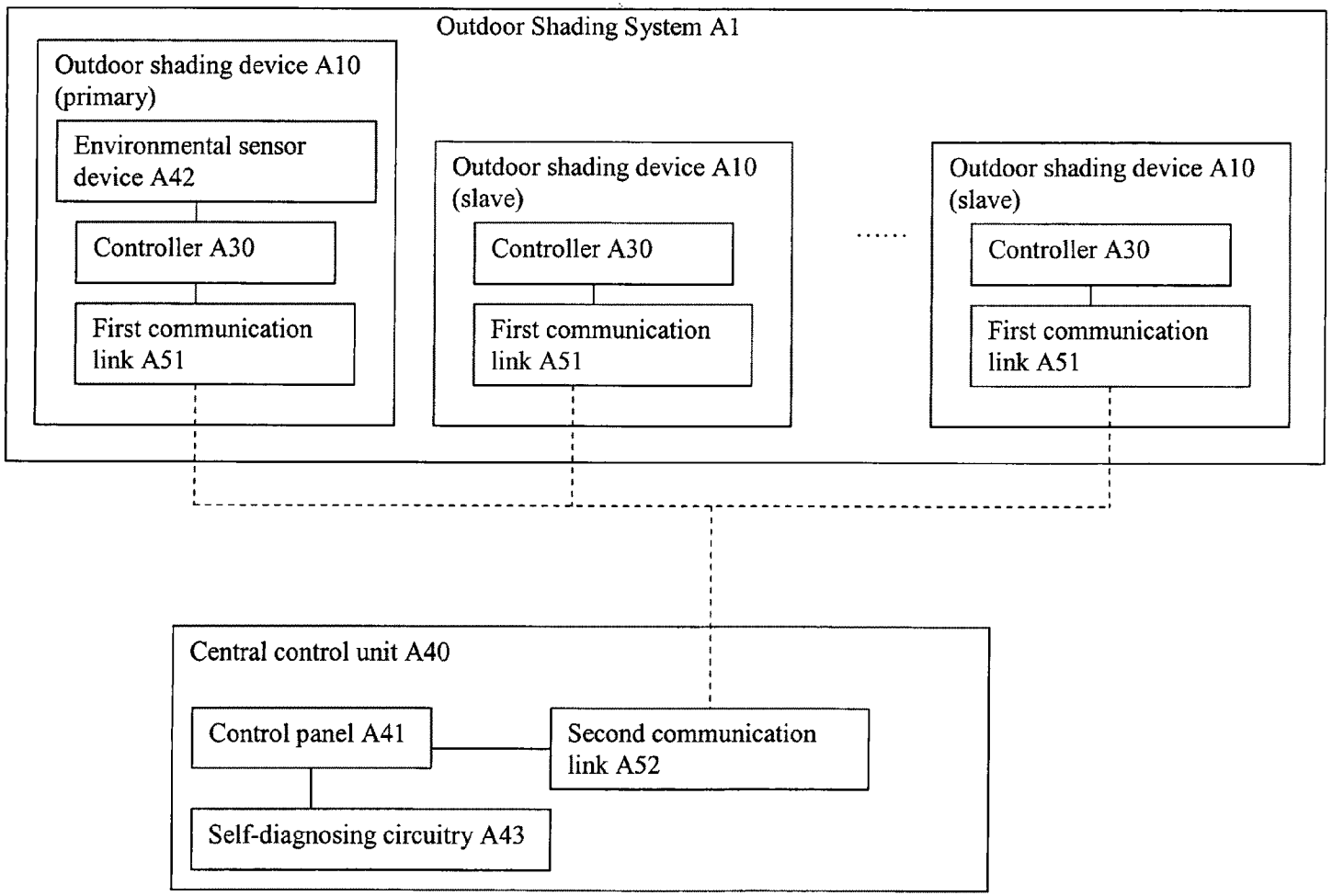
FIG. 6 is a block diagram of the remote control system according to a preferred embodiment of the present invention, illustrating the remote control system synchronously operating the group of outdoor shading devices.
Figure 7:
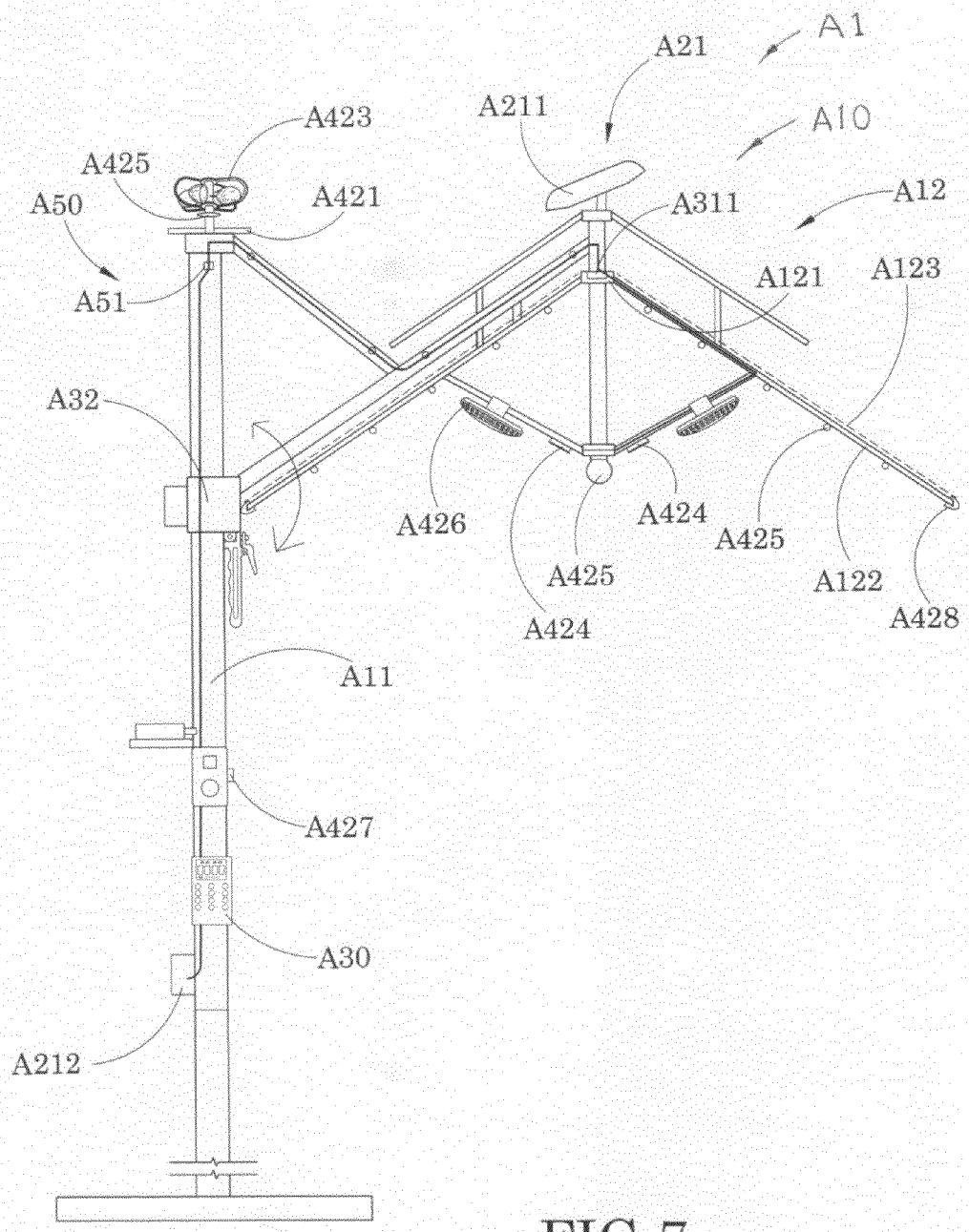
FIG. 7 is an elevation view of the outdoor shading device incorporating with the remote control system according to the above preferred embodiment of the present invention.
Figure 8:
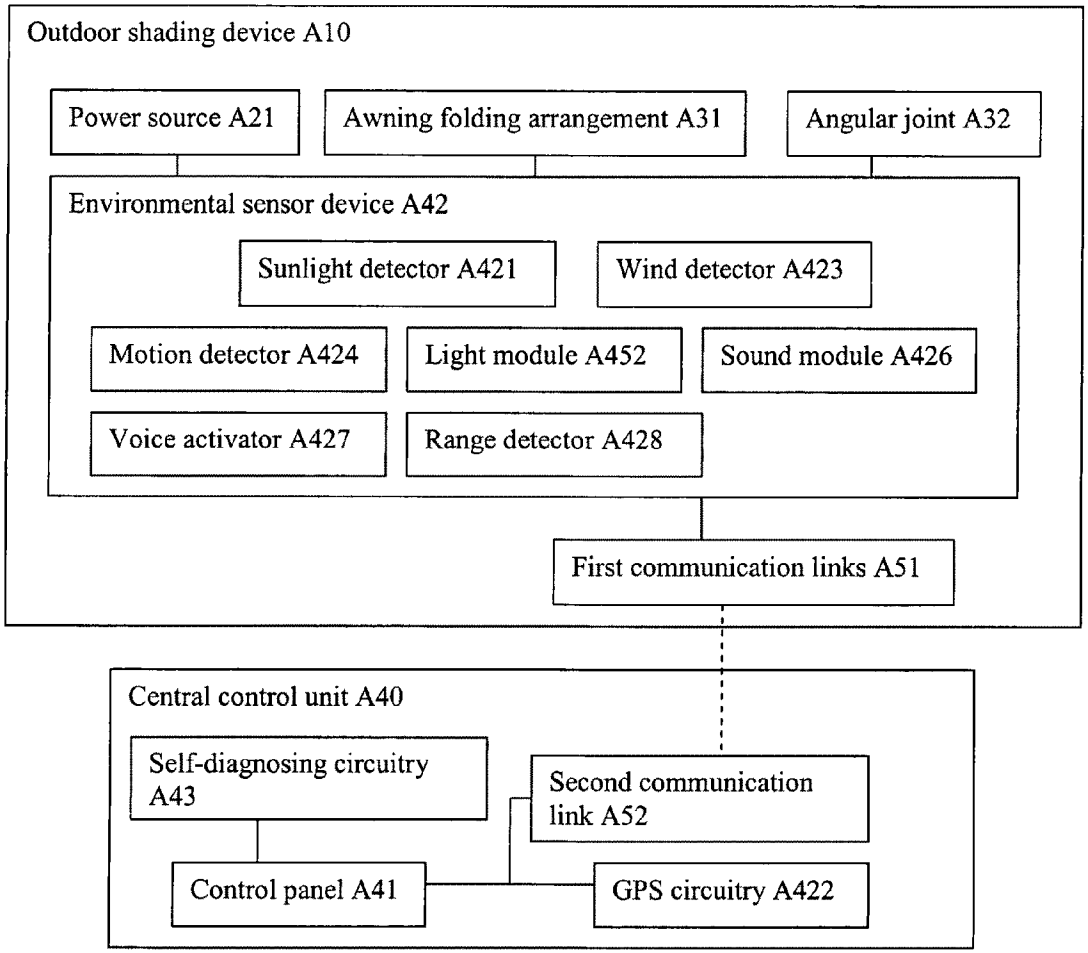
FIG. 8 is a block diagram of remote control system according to the above preferred embodiment of the present invention, illustrating the environmental sensor device incorporating with the outdoor shading device.

Referring to FIGS. 6 to 8 of the drawings, an outdoor shading system of the intelligence outdoor shading arrangement according to a second preferred embodiment of the present invention is illustrated, wherein the outdoor shading system A1 comprises a group of outdoor shading devices A10 and a remote control system A20 operatively linked to the outdoor shading devices A10 for centrally controlling the outdoor shading devices A10 in a remotely manner, so that a user of the outdoor shading devices is able to remotely control two or more outdoor shading devices A10 while being time effectively.

According to the preferred embodiment, each of the outdoor shading devices A10, which is embodied as a conventional outdoor umbrella, comprises a supporting frame A11 and an awning frame A12 movably supported by the supporting frame A11 to define a shading area under the awning frame A12.

It will be readily appreciated by one skilled in the art that the outdoor shading devices A10 could be any other shapes or types of shading devices A10. For instance, a window cover could be the outdoor shading device A10 for being remotely controlled by the remote control system A20, wherein the window cover has the supporting frame installed and positioned at the window and an awning frame supported by the supporting frame, wherein an awning shelter may be supported by the awning frame to be remotely control a shading effect by the remote control system A20. The outdoor shading device A10 could also be a pavilion, gazebo or canopy type thereof for sun, rain, or wind shading.

As shown in FIG. 7, the awning frame A12 comprises a housing A121 suspendedly supported by the supporting frame A11, a plurality of awning arms A122 radially and pivotally coupling with the housing A121, and an awning shelter A123 supported by the awning arms A122 to define the shading area under the awning shelter A123. It is worth mentioning that the awning frame A12 of each of the outdoor shading devices A10 is adapted to fold between a folded position and an unfolded position. At the folded position, the awning arms A122 are pivotally moved with respect to the housing A121 at a position that the awning shelter A123 is folded up to minimize the shading area thereof. At the unfolded position, the awning arms A122 are pivotally moved at a position that the awning shelter A123 is expanded to maximize the shading area thereof.

The remote control system A20 comprises a power source A21 and a plurality of controllers A30 provided at the outdoor shading devices A10 to electrically connect to the power sources A21 respectively, wherein an operation of each of the outdoor shading devices A10 is controlled by the respective controller A30.

The remote control system A20 further comprises a central control unit A40 remotely linked to the controllers A30 to form a control network of the outdoor shading devices A10, wherein the central control unit A40 synchronously activates the controllers A30 to concurrently control the operation of all the outdoor shading devices A10 of the shading system A1 in responsive to an environmental change of the control network.

Figure 9:
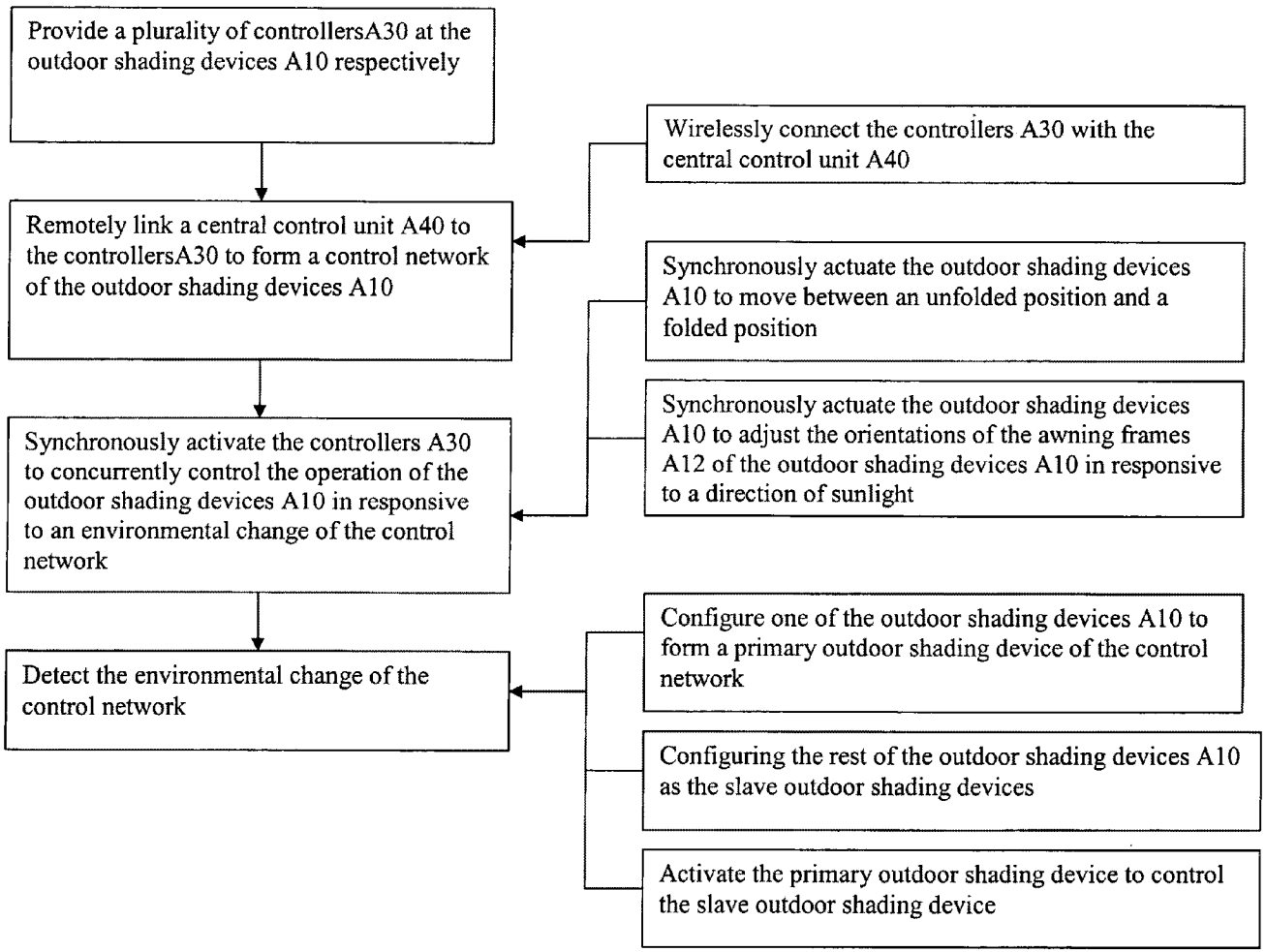
FIG. 9 is a flow chart of a remote control method for controlling two or more shading devices according to the preferred embodiment of the present invention.

As shown in FIG. 9, the present invention also provides a method of remotely controlling a group of outdoor shading devices A10, which comprises the following steps.

(1) Provide the controllers A30 at the outdoor shading devices A10 respectively. Accordingly, the controllers A30 can be built-in with the outdoor shading devices A10 respectively that each of the outdoor shading devices A10 already has the controller A30 to control the operation. Alternatively, the controller A30 can be an external device added-on to each of the outdoor shading devices A10.

(2) Remotely link the central control unit A40 to the controllers A30 to form the control network of the outdoor shading devices A10.

(3) Synchronously activate the controllers A30 to concurrently control the operation of the outdoor shading devices A10 in responsive to the environmental change of the control network.

According to the preferred embodiment, each of the controllers A30 comprises an awning folding arrangement A31 operatively linked to the awning frame A12 of the respective outdoor shading device A10 to selectively actuate the awning frame A12 between the unfolded position and the folded position. The awning folding arrangement A31 comprises an electro servo A311 electrically powered by the respective power source A21 to drive the awning arms A122 to move between the unfolded position and the folded position. It is worth mentioning that when the central control unit A40 is remotely activated, the outdoor shading devices A10 within the control network are synchronously actuated to move between the unfolded position and the folded position, as in the step (3).

Each of the controllers A30 further comprises an angular joint A32 which is powered by the respective power source A21 and is coupling at the awning frame A12 of the respective outdoor shading device A10 to selectively adjust an orientation of the awning frame A12 in responsive to a direction of sunlight. Therefore, the awning frame A12 can be adjusted to face towards the direction of the sun for maximizing the shading effect of the awning frame A12. Accordingly, when the central control unit A40 is remotely activated, the outdoor shading devices A10 are synchronously actuated to adjust the orientations of the awning frames 12 of the outdoor shading devices 10, as in the step (3).

In other words, the central control unit A40 forms a central controller to concurrently operate all the outdoor shading devices A10 within the control network at the same time. Accordingly, the central control unit A40 comprises a control panel A41, having a plurality of preference settings, remotely linked to controllers A30 for synchronously activating the outdoor shading devices A10 in responsive to the preference settings.

In order to utilize an environmentally friendly power source as the power source A21 of the present invention, the power source A21 comprises a plurality of solar energy collecting panels A211 supported out of the shading area of the outdoor shading devices A10, for example above the awning frame A12, for collecting solar energy and converting the solar energy into electrical energy, and a power storage A212 operatively connected to the solar energy collecting panels A211 for storing the electrical energy. Accordingly, the power storage A212 can be supported at each of the outdoor shading devices A10 for supplying energy to the corresponding controller A30. Alternatively, the power storage A212 can be located away from the outdoor shading devices A10.

Accordingly, the user is able to select one of the preference settings at the control panel A41 to selectively operate the designated outdoor shading devices A10. For example, when the control panel A41 is activated, such as a "POWER" key is activated, all the outdoor shading devices A10 are set at the standby mode. When an "ON" key is activated on the control panel A41, all the outdoor shading devices A10 will be automatically operated to move the awning frames A12 at the unfolded position. When an "OFF" key is activated on the control panel A41, all the outdoor shading devices A10 will be automatically operated to move the awning frames A12 at the folded position.

The central control unit A40 comprises an environmental sensor device A42 operatively linked to the controllers A30 for detecting the environmental change of the control network in such a manner that the outdoor shading devices A10 are synchronously activated to be operated to automatically adjust the awning frame A12 in responsive to the environmental change of the control network.

Accordingly, the environmental sensor device A42 is arranged to gather a plurality of environment factors and transmit the corresponding signal of the environment factors information to the controller A30 for being processed, so that the controller A30 send out a related signal to activate the corresponding shading devices A10 in responsive to the information gathered via the environmental sensing device A42.

It is appreciated that the environmental sensor device A42 can be installed at any outdoor position that can experience the same environmental factors, sunlight, wind, sound, and etc., as the group of outdoor shading devices A10 of the outdoor shading system A1. According to the preferred embodiment, the environmental sensor device A42 can be supported at one of the outdoor shading devices A10 to form a primary outdoor shading device A10 of the control network. The rest of the outdoor shading devices become a plurality of slave outdoor shading devices A10, wherein when the primary outdoor shading device A10 is activated to be operated in responsive to the environmental change of the control network, the slave outdoor shading devices A10 are correspondingly operated in relation to the primary outdoor shading device A10.

In other words, the user is able to pick one of the outdoor shading devices A10 to become the primary outdoor shading device A10 by locating the environmental sensor device A42 thereat to minimize the material cost of the environmental sensor device A42 incorporating with all the outdoor shading devices A10.

Figure 10:
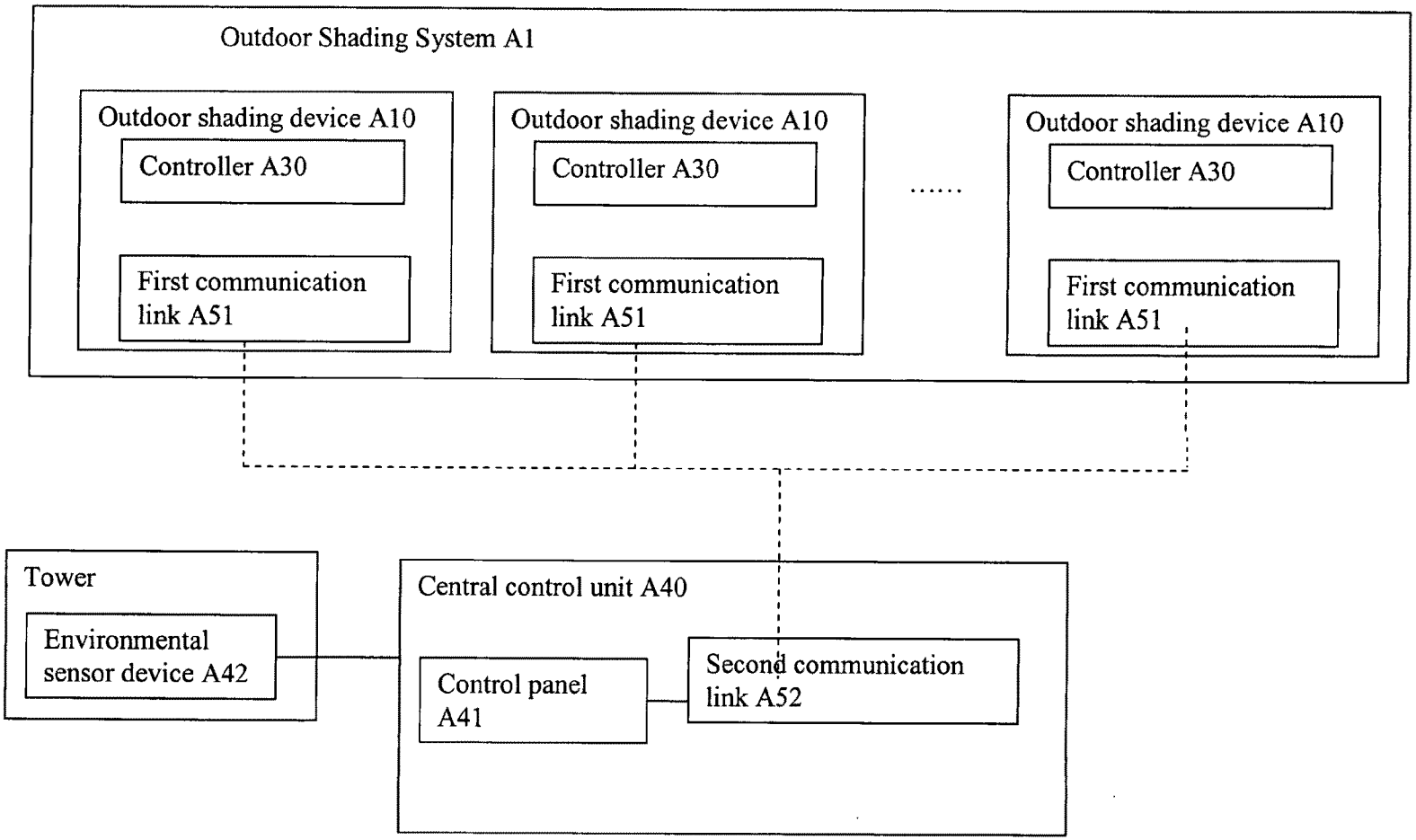
FIG. 10 illustrates an alternative configuration of the environmental sensor device incorporating with the outdoor shading device according to the above preferred embodiment of the present invention.

It is appreciated that each of the outdoor shading devices A10 can incorporate with its own environmental sensor device A42 such that each of the outdoor shading devices A10 can be self adjusted in responsive to its own environmental sensor device A42 while all the outdoor shading devices A10 can be centralized and controlled by the central control unit A40. In addition, the environmental sensor device A42 can be provided at an individual tower which is located away from the outdoor shading devices A10 for detecting the environmental change of the control network, as shown in FIG. 10.

Therefore, the environmental sensor device A42 can precisely detect the environmental change to regulate the outdoor shading devices A10.

Accordingly, the configuration of the control network in responsive to the detection of the environmental change of the control network via the environmental sensor device A42 comprises the following step.

(4.1) Configure one of the outdoor shading devices A10 to form the primary outdoor shading device of the control network by locating the environmental sensor device 42 thereat.

(4.2) Configure the rest of the outdoor shading devices A10 as the slave outdoor shading devices.

(4.3) Activate the primary outdoor shading device A10 to be operated through the central control unit A40 in responsive to the environmental change of the control network, wherein the slave outdoor shading devices A10 are correspondingly operated in relation to the primary outdoor shading device A10.

According to the preferred embodiment, the environmental sensor device A42 comprises, but not limited to, a sunlight detector A421, a GPS circuitry A422, a wind detector A423, a motion detector A424, a light module A452, and a sound module A426.

The sunlight detector A421 is adapted for detecting the direction of sunlight, wherein the sunlight detector A421 is provided at one of the outdoor shading devices A10, i.e. the primary outdoor shading device. Preferably, the sunlight detector A421 is placed above the awning shelter A123 of the awning frame A12, for example at a position on top of the supporting frame A11, and is operatively linked to the central control unit A40 such that, when the sunlight detector A421 detects the direction of the sun, the central control unit A40 will receive the detection signal from the sunlight detector A421 to synchronously activate the outdoor shading devices A10 so as to automatically adjust the awning frame A12 in responsive to the direction of the sun for enhancing the shading effect of each of the outdoor shading devices A10. According to an embodiment, the sunlight detector A421 can be embodied as a GPS device coupled at the primary outdoor shading device A10.

Likewise, the GPS circuitry A422 is adapted for automatically tracking the direction of the sun so as to define the geographical location of the sun. The GPS circuitry A422 can be built-in with the central control unit A40 such that the GPS circuitry A422 will send out the GPS signal to the central control unit A40 to automatically adjust the awning frame A12 in responsive to the direction of the sun for enhancing the shading effect of each of the outdoor shading devices A10.

The wind detector A423 is arranged for detecting the direction of the wind loading at the awning frame A12, wherein the wind detector A423 is preferred to be provided on top of one of the outdoor shading devices A10, i.e. the primary outdoor shading device. Preferably, the wind detector A423 is placed above the awning frame A12 at a position on top of the supporting frame A11 and is operatively linked to the central control unit A40. When the wind detector A423 detects the direction of the wind, the central control unit A40 will receive the detection signal from the wind detector A423 to synchronously activate the outdoor shading devices A10 so as to automatically adjust the awning frame A12 via the corresponding awning folding arrangement A31 and angular joint A32.

Therefore, the awning frame A12 of each of the outdoor shading devices A10 will be self-adjusted to minimize the wind loading at the awning frame A12 or to fold up the awning frame A12 so as to avoid the outdoor shading device A10 to be accidentally flipped over and causing personal injuries. The wind detector A423 can be a conventional mechanical type wind detector which is capable of detecting the velocity of the incoming wind so that it can transmit the corresponding detection signal to the central control unit A40 when the adjustment of angle of inclination of the awning frame A12 is necessary. It is worth mentioning that the central control unit A40 will optimize the operation of the outdoor shading devices A10 that when the velocity of the wind is higher than a preset threshold, all the outdoor shading devices A10 will be automatically folded at the folded position. Otherwise, the outdoor shading devices A10 will be automatically self-adjusted to minimize the wind loading at the awning frames A12.

The motion detector A424 is arranged for detecting the presence of a user within a detecting area of the respective outdoor shading device A10, wherein the motion detector A424 is preferably mounted at the awning frame A12 of each of the outdoor shading devices A10 within the shading area and is operatively linked to the central control unit A40. Therefore, when the motion detector A424 detects the presence of the user within the detecting area of the respective outdoor shading device A10, the outdoor shading device A10 will be automatically folded to its unfolded position. Once the user leaves the outdoor shading device A10, i.e. out of the detecting area of the motion sensor A424, the outdoor shading device A10 will be automatically folded to its folded position.

The light module A425 is arranged for detecting a light level of an environment of the outdoor shading device A10 to illuminate the shading area thereof, wherein the light module A425 is preferably provided at the awning frame A12 within the shading area thereof and is operatively linked to the central control unit A40. Preferably, the light module A425 comprises a photosensor placed on top of the supporting frame 11 for detecting a light brightness of the shading area, and an illumination unit which is supported by the awning frame A12 within the shading area and is arranged in such a manner that when the light brightness of the shading area detected by the photosensor is lower than a preset light level threshold, the illumination unit is activated for providing extra illumination to the shading area. Once the ambient brightness of the shading area is above the threshold, the illumination unit is deactivated. Accordingly, the illumination unit can be a conventional light bulb, or a plurality of LEDs for providing optimal illumination to the shading area.

The sound module A426 is arranged for generating an audio effect when the respective outdoor shading device A10 is in use, wherein the sound module A426 comprises an audio speaker supported at the awning frame A12 of each of the outdoor shading devices A10 and operatively linked to the central control unit A40 for delivering audible sound to the outdoor shading device A10 when the sound module A426 is activated. It is worth mentioning that the light module A425 and the sound module A426 are preferably activated by the central control unit A40 when the respective outdoor shading device A10 is folded at its unfolded position. Once the outdoor shading device A10 is folded at its folded position, i.e. the outdoor shading device A10 is not in use, the light module A425 and the sound module A426 are deactivated by the central control unit A40.

It is appreciated that the environmental sensor device A42 further comprises a voice activator A427 and a range detector A428. The voice activator A427 is mounted at each of the outdoor shading devices A10 and is operatively linked to the central control unit A40, such that when the voice activator A427 detects an audio command, the light module A425 and the sound module A426 are activated for generating illumination and audio effect respectively.

The range detector A428 is preferably mounted at each of the outdoor shading devices A10 at the awning frame A12 and is operatively linked to the central control unit A40 for detecting the presence of the user within an awing folding range of the respective outdoor shading device A10. Therefore, at the time the range detector A428 detects the presence of the user when the awning frame A12 is folded between the folded position and the unfolded position, the awning folding arrangement A31 will be automatically deactivated to stop the folding movement of the awning frame A12 for safety purpose.

As it is mentioned above, the user is able to select one of the preference settings at the control panel A41 to selectively operate the designated outdoor shading devices A10. The central control unit A40 is selectively activated through the preference settings of the control panel A41 to activate all the outdoor shading devices A10 at the standby mode. At the standby mode, each of the outdoor shading devices A10 will be self-adjusted in responsive to its own setting. For example, the motion detector A424 will be activated to determine whether the respective outdoor shading device A10 needs to be folded at its unfolded position. Once the outdoor shading device A10 is at its unfolded position, the light module A425 and the sound module A426 will be activated automatically. The sunlight detector A421, the GPS circuitry A422, and the wind detector A423 will be activated when the outdoor shading devices 10 are folded at the unfolded position. Therefore, the central control unit A40 will provide an intelligent control system to monitor and control the outdoor shading devices A10. It is appreciated that the central control unit A40 can concurrently control all the controllers A30 to fold and unfold the outdoor shading devices A10. Preferably, a timer module can be built-in the central control unit A40 to operate the outdoor shading devices A10 in a timely manner.

For example, when some of the outdoor shading devices A10 are not in use at the outdoor area of the restaurant, the vacated outdoor shading devices A10 will be automatically folded up to prevent the view from being blocked, while the vacated outdoor shading devices A10 will also save the energy by setting them at the low-powered status.

According to the preferred embodiment, the remote control system A20 further comprises a wireless link A50 for wirelessly connecting the controllers A30 with the central control unit A40 to form the control network in a wireless manner. The wireless link A50 comprises a plurality of first communication links A51 operatively linked to the controllers A30 respectively, and a second communication link A52 operatively linked to the central control unit A40 to wirelessly communicate with the first communication links A51, such that the central control unit A40 synchronously activates the outdoor shading devices A10 to concurrently control the operation of the outdoor shading devices A10 in a wireless manner.

Accordingly, the central control unit A40 is able to wirelessly transmit the wireless control signal to the controllers A30 for synchronously controlling the outdoor shading devices A10. It is worth to mention that the first and second communication links A51, A52 can be wirelessly linked by infrared or radio frequency (RF), which has a relatively wider range of electromagnetic radiation, so that the wireless control signal of the remote control system A20 is able to cover longer distance in the wireless manner, so as to enhance the signal transmitting quality thereof. Thus, the first and second communication links A51, A52 can simplify the installation and configuration of the remote control system A20 by eliminating the pre-wiring process thereof.

According to the preferred embodiment, the central control unit A40 further comprises a self-diagnosing circuitry A43 operatively linked to the controllers A30 to perform a self-diagnosing test of each of the controllers A30. Therefore, the central control unit A40 can automatically determine when one of the outdoor shading devices A10 is malfunctioned.

The operation of the remote control system A20 of the present invention comprises the following steps.

(a) Activate the central control unit A40 to activate the controllers A30 such that all the outdoor shading devices A10 within the control network will be activated at the standby mode. Preferably, the self-diagnosing test runs at each of the controllers A30 when the controller A30 is activated.

(b) Select the preference settings at the control panel A41 according to the user preference.

In the step (b), the user is able to unfold all the outdoor shading devices A10 concurrently by one touch of the control panel A41 such that all the outdoor shading devices A10 are ready to use. Alternatively, each of the outdoor shading devices A10 will be remained at the unfolded position until the respective outdoor shading device A10 is needed to be used.

(c) Set the central control unit A40 at the "auto" mode that the central control unit A40 synchronously activates the controllers A30 to concurrently control the operation of the outdoor shading devices A10 in responsive to the environmental change of the control network.

Accordingly, at the "auto" mode, each of the controllers A30 can be individually operated to selectively operate the respective outdoor shading device A10 by switching the motion detector A424, the light module A452, and the sound module A426 in an on and off manner. In addition, at the "auto" mode, the controllers A30 are centralized and controlled by the central control unit A40 to activate the sunlight detector A421, the GPS circuitry A422, and the wind detector A423 so as to synchronously operate the outdoor shading devices A10. It is worth mentioning that the light module A452 and the sound module A426 can be controlled by the central control unit A40 such that the user is able to switch on and off the light module A452 and the sound module A426 by one touch of the control panel A41.

(d) Deactivate the central control unit A40 to switch off the controllers A30 such that all the outdoor shading devices A10 within the control network will be deactivated and will be folded back to the folded position.

It is appreciated that the remote control system A20 may comprise a plurality of communication wires being pre-wired for electrically connecting each of the controllers A30 and the central control unit A40 to communicatively operate the outdoor shading devices A10 via the central control unit A40.

Figure 11:
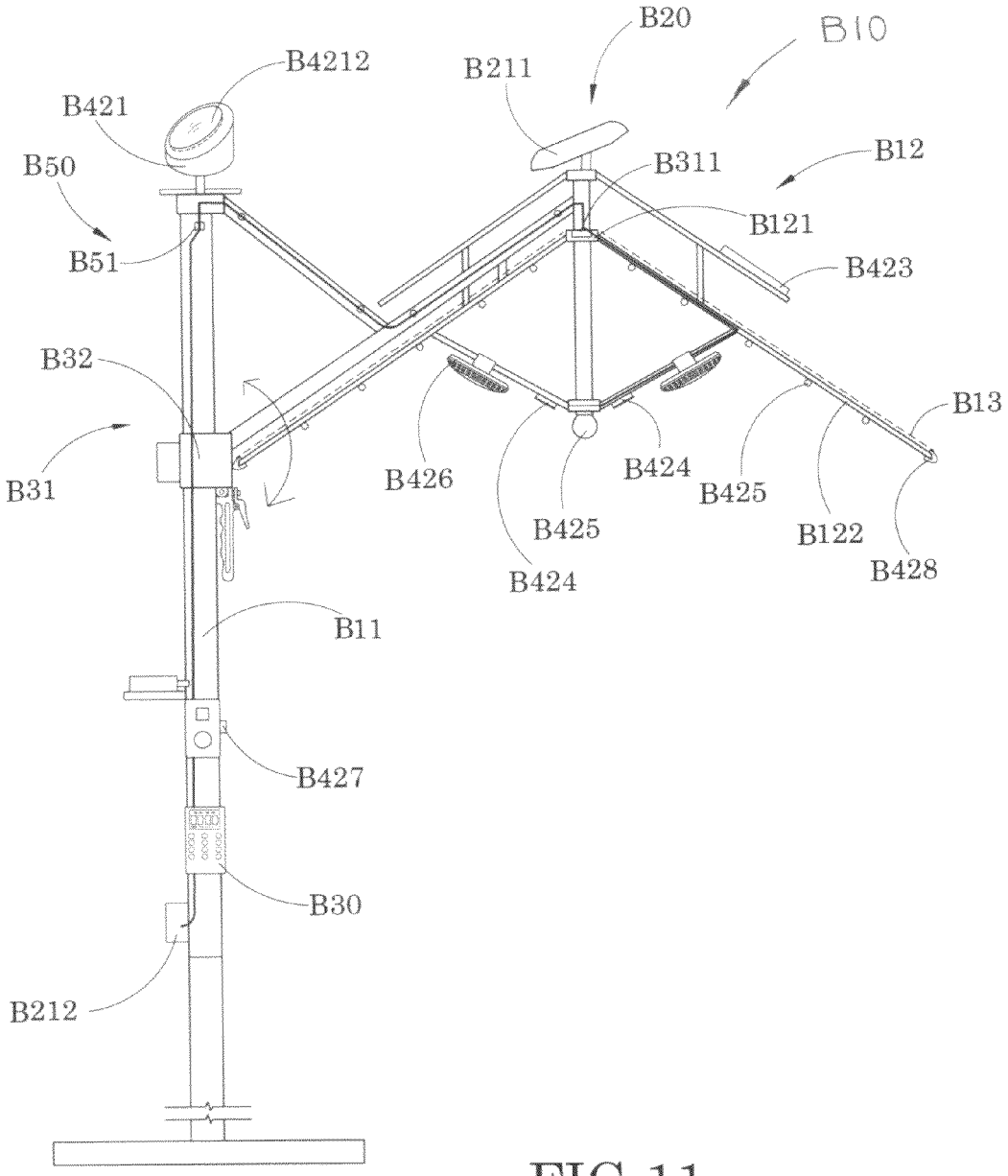
FIG. 11 is an elevation view of an intelligence outdoor shading arrangement according to another preferred embodiment of the present invention.
Figure 12:
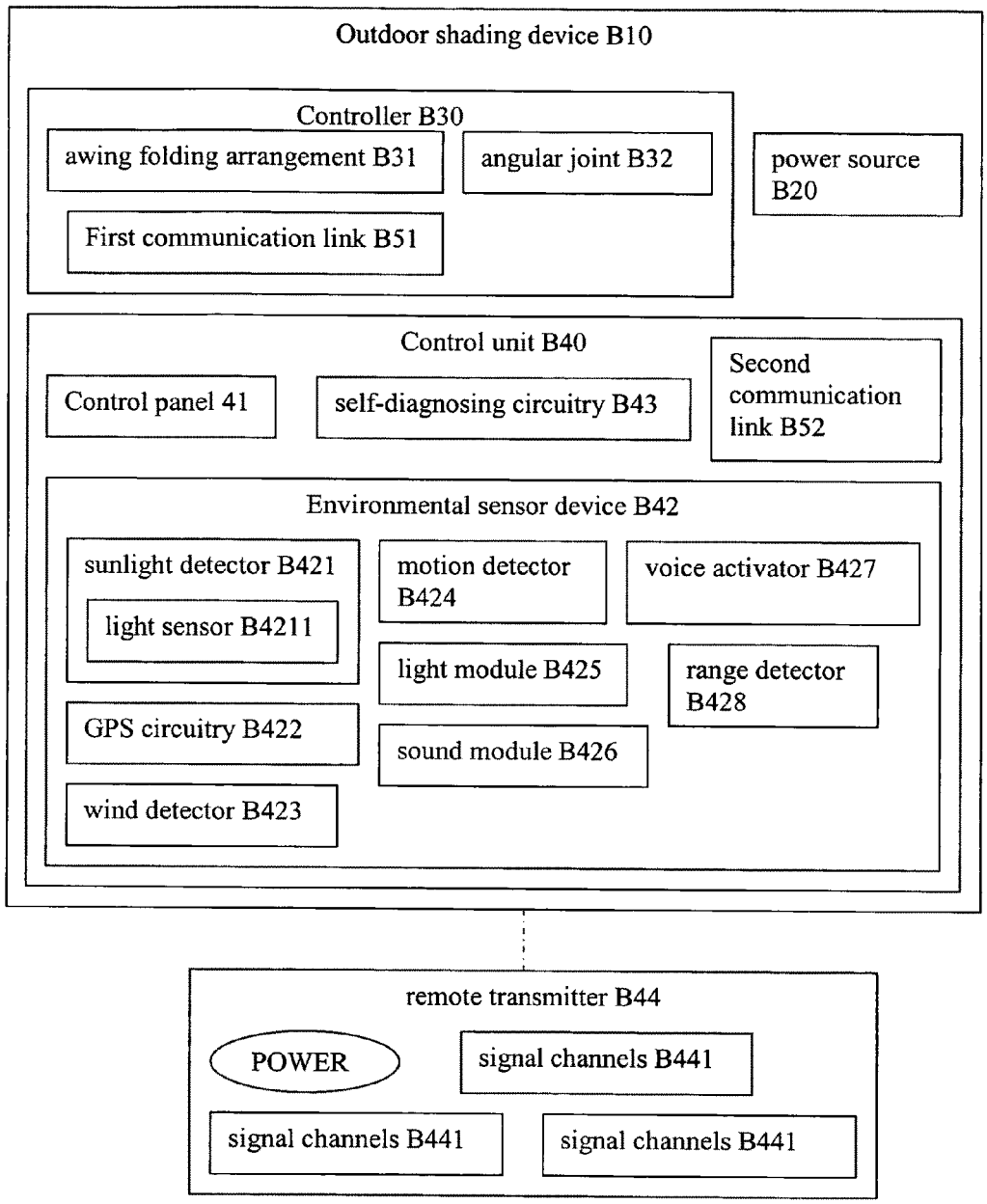
FIG. 12 is a block diagram of the intelligence outdoor shading arrangement according to the above mentioned preferred embodiment of the present invention.

Referring to FIGS. 11 and 12 of the drawings, an intelligence outdoor shading arrangement according to an alternative mode of the above preferred embodiments of the present invention is illustrated, wherein each of the outdoor shading devices (or the primary outdoor shading device) B10 comprises a supporting frame B11 and a shelter B13 operatively supported by the supporting frame B11 for being set up to an unfolded position to define a shading area and to a folded position when the outdoor shading device B10 is not is use.

According to the alternative mode, the shelter B13 could be an awning for providing the above mentioned shading area, so as to protectively block the sun, rain, wind, or any other environmental conditions. The outdoor shading device B10 preferably comprises an awning frame B12 movably coupling with the supporting frame B11, in such a manner that the shelter B13 is being supported by the awning frame B12 to operatively couple with the supporting frame B11 and to movably form the folded and unfolded position.

Also, in the alternative mode, the outdoor shading device B10 is preferably an outdoor shading umbrella type. As a result, the awning frame is being supported on the awning frame B13 to define the shading area thereunder. It should be noted that the outdoor shading device B10, which could be any other type of outdoor shading devices, is not limited in the shape as mentioned in the preferred embodiment. For example, the outdoor shading device may have a supporting frame coupling at a top peripheral edge of a house at a location adjacent to the window thereof, wherein the awning frame is retractably coupling with the supporting frame to extend between a retracted position and a fully extended position to form the shading area, so as to prevent the sun directly pouring into the house through the window.

As shown in FIG. 11, the awning frame B12 comprises a housing B121 suspendedly supported by the supporting frame B11, a plurality of awning arms B122 radially and pivotally coupling with the housing B121, and the shelter B13 supported by the awning arms B122 to define the shading area under the shelter B13. It is worth mentioning that the awning frame B12 of each of the outdoor shading devices B10 is adapted to fold between the folded position and the unfolded position. At the folded position, the awning arms B122 are pivotally moved with respect to the housing B121 at a position that the shelter B13 is folded up to minimize the shading area thereof. At the unfolded position, the awning arms B122 are pivotally moved at a position that the shelter B13 is expanded to maximize the shading area thereof.

The outdoor shading device B10 may further comprises a power source B20, a controller B30 electrically linking to the power source B20 for supplying power thereto, and a control unit B40 operatively linked to the controller B30 for adjustably and automatically controlling the controller B30.

Accordingly, the controller B30 preferably comprises at least an awning folding arrangement B31 operatively linked to the awning frame B12 of the respective outdoor shading device B10 to selectively actuate the awning frame B12 between the unfolded position and the folded position. The awning folding arrangement B31 preferably comprises an electro servo B311 electrically powered by the respective power source B20 to drive the shelter B13 to move between the unfolded position and the folded position.

The controller B30 may further comprise an angular joint B32 which is powered by the power source B20 and is coupling at the awning frame B12 of the respective outdoor shading device B10 to selectively adjust an orientation of the awning frame B12 in responsive to a direction of sunlight. Therefore, the awning frame B12 can be adjusted to face towards the direction of the sun for maximizing the shading effect of the awning frame B12. Accordingly, when the control unit B40 is activating the controller B30 and sending out a corresponded command thereto, the controller B30 is actuated to adjust the orientations of the awning frames B12 of the outdoor shading device B10. Therefore, the operation of the outdoor shading device B10 is controlled by the respective controller B30.

Accordingly, the central control unit B40 comprises a control panel B41, having a plurality of preference settings, remotely linked to controllers B30 for synchronously activating the outdoor shading devices B10 in responsive to the preference settings.

Accordingly, when the central control unit B40 is remotely activated, the outdoor shading devices B10 are synchronously actuated to adjust the orientations of the awning frames B12 of the outdoor shading devices B10, as in the step (3).

In order to utilize an environmentally friendly power source as the power source B20 of the present invention, the power source B20 preferably powered by solar energy, wherein the power source B20 may comprise a plurality of solar energy collecting panels B211 supported above the awning frame for collecting solar energy and converting the solar energy into electrical energy, and a power storage operatively connected to the solar energy collecting panels for storing the electrical energy. Accordingly, the power storage can be supported at each of the outdoor shading devices B10 for supplying energy to the corresponding controller B30. Alternatively, the power storage can be located away from the outdoor shading devices B10.

Accordingly, the user is able to select one of the preference settings at the control panel A41 to selectively operate the outdoor shading device B10. For instance, when the control panel B41 is activated, such as a "POWER" key is activated, the outdoor shading device B10 is activated, the outdoor shading device B10 is set at a standby mode. When an "ON" key is activated on the control panel B41, the outdoor shading device B10 will be automatically operated to move the awning frame B12 at the unfolded position. When an "OFF" key is activated on the control panel B41, the outdoor shading device B10 will be automatically operated to move the awning frames B12 at the folded position.

The central control unit B40 preferably comprises an environmental sensor device B42 operatively linked to the controller B30 for detecting the environmental change of the shading area and its environment, in such a manner that the outdoor shading device B10 is activated to be operated to automatically adjust the awning frame B12 in responsive to the environmental change of outdoor shading device B10.

Accordingly, the environmental sensor device B42 is arranged to gather a plurality of environment factors and transmit the corresponding signal of the environment factors information to the controller B30 for being processed, so that the controller B30 send out a related signal to activate the corresponding shading devices B10 in responsive to the information gathered via the environmental sensing device B42.

It is appreciated that the outdoor shading devices B10 can incorporate with its own environmental sensor device B42 such that the outdoor shading device B10 can be self adjusted in responsive to its own environmental sensor device A42. In addition, the environmental sensor device B42 can be provided at an individual tower which is located away from the outdoor shading device B10 for detecting the environmental change thereof. Therefore, the environmental sensor device B42 can precisely detect the environmental change to regulate the outdoor shading device B10.

According to the preferred embodiment, the environmental sensor device B42 may comprise a sunlight detector B421, a GPS circuitry B422, a wind detector B423, a motion detector B424, a light module B425, and/or a sound module B426.

The sunlight detector B421 is adapted for detecting the light level of the environment of the outdoor shading device B10, wherein the sunlight detector B421 is preferably has at least a light sensor B4211 for detecting the intensity of the sun light or environment light, and a solar collecting unit B4212 having a solar collecting panel for receiving the environmental light and a solar cell for storing the collected environmental light into electricity, so as to self supply the power to the light sensor B4211. Therefore, the sunlight detector B421 is able to adjustably control the outdoor shading device B10 by transmitting a signal to the controller B30 in responsive to the sensed light level.

For instance, the sunlight detector B may have a setting button for adjustably and manually setting the light level threshold. Therefore, when the light sensor B4211 of the sunlight detector B421 detects the light level falls below a pre-set threshold setting, an order is sent to the controller B30 to fold the shelter B13. When the detected light level exceeds the threshold set by the sunlight detector B421, another order may be sent to the controller B30 for folding the shelter B13 at the unfolded position, so as to form the shading area for protection from sun light or environmental light.

Preferably, the sunlight detector B421 has a communication link B51 for cordlessly communicating with the control panel B41 and for being remotely controlled. It is worth to mention that the sunlight detector B421 is able to wirelessly and electrically connect to the controller B30 through the control panel B41 so that the installation of the sunlight detector is simplified. The sunlight detector B421 is preferred to be placed above the outdoor shading device B10 at a position at the top of the supporting frame B11 to maximize the sensitivity thereof, so as to maximize the sun light collecting area.

Likewise, the GPS circuitry B422 is adapted for automatically tracking the direction of the sun so as to define the geographical location of the sun. The GPS circuitry B422 can be built-in with the control unit B40 such that the GPS circuitry B422 will send out the GPS signal to the control unit B40 to automatically adjust the awning frame B12 in responsive to the direction of the sun for enhancing the shading effect of each of the outdoor shading devices B10.

The wind detector B423 is adapted for detecting the movement of the outdoor shading device B10, primary the movement of the supporting frame B11 and/or awning frame B12 generated by the wind. Accordingly, the wind detector B423 is preferably mounted at a top front end edge of the supporting frame B11 or awning frame B12, so that the wind generated movement of the shading device B10, such as shading movement, is relatively easier to be detected. Preferably, the wind detector B423 is operatively linked to the control unit B40. When the wind detector B423 detects the shaking movement of the outdoor shading device B10 generated by wind, the control unit B40 will receive the detection signal from the wind detector B423 to activate the outdoor shading device B10, so as to automatically adjust the awning frame B12 via the corresponding awing folding arrangement B31 and the angular joint B32. Therefore, the awning frame B12 of the outdoor shading device B10 can be self-adjusted to minimize the wind loading at the awning frame B12 or to fold up the awning frame B12 to avoid the outdoor shading device B10 to be accidentally flipped over and causing personal injuries.

Accordingly, the wind detector B423 is preferably elongated shaped for easily being installed at the front end edge of the awning arm B122 of the awning frame B12, so as to easily detect the movement generated by the wind around the outdoor shading device B10. Therefore, the wind detector B423 may has an elongated casing for housing a movement sensor and a power source, such as batteries or solar cells, so that the wind detector B423 is able to be easily incorporating with the outdoor shading device B10 by mounted at the casing thereof at the awning arm B122 in the above mentioned wireless manner.

It should be noted that the control unit B40 will optimize the operation of the outdoor shading device B10 that when the shaking movement generated by the wind is higher than a preset threshold, the outdoor shading device B10 will be automatically folded at the folded position. Otherwise, the outdoor shading device B10 will be automatically self-adjusted to minimize the wind loading at the awning frame B12.

In other words, the wind detector B423 has a communication link for wirelessly and operatively connecting to the controller B30, so that the controller B30 is able to controllably adjust the position of the outdoor shading device B10 in responsive to the environmental factors of wind collected by the wind detector B423. It is worth to mention that the wind detector B423 could be battery or solar cell powered, wherein the wind detector B423 is easily to install in the wireless manner via the communication link to cordlessly link to the controller B30 and in a tool less manner, so as to simplify the installation process thereof. The wind detector B423 also has a memory for memorizing the automatically pre-set settings and/or the manually settings in a one time manner. Therefore, there is no need for re-setting or re-programming the wind detector B423.

The motion detector B424 is arranged for detecting the presence of a user within a detecting area of the respective outdoor shading device B10, wherein the motion detector B424 is preferably mounted at the awning frame B12 of each of the outdoor shading devices B10 within the shading area and is operatively linked to the central control unit B40. Therefore, when the motion detector B424 detects the presence of the user within the detecting area of the respective outdoor shading device B10, the outdoor shading device B10 will be automatically folded to its unfolded position. Once the user leaves the outdoor shading device B10, i.e. out of the detecting area of the motion sensor B424, the outdoor shading device B10 will be automatically folded to its folded position.

The light module B425 is arranged for detecting a light level of an environment of the outdoor shading device B10 to illuminate the shading area thereof, wherein the light module B425 is preferably provided at the awning frame B12 within the shading area thereof and is operatively linked to the central control unit B40. Preferably, the light module B425 comprises a photosensor placed on top of the supporting frame B11 for detecting a light brightness of the shading area, and an illumination unit which is supported by the awning frame B12 within the shading area and is arranged in such a manner that when the light brightness of the shading area detected by the photosensor is lower than a preset light level threshold, the illumination unit is activated for providing extra illumination to the shading area. Once the ambient brightness of the shading area is above the threshold, the illumination unit is deactivated. Accordingly, the illumination unit can be a conventional light bulb, or a plurality of LEDs for providing optimal illumination to the shading area.

It should be noted that the illumination unit of the light module B425 may be electrically connected to the sun light detector B421 for being activated in responsive to the light level or light brightness detected by the sunlight detector B421 to replace the photosensor of the light module B425.

The sound module B426 is arranged for generating an audio effect when the respective outdoor shading device B10 is in use, wherein the sound module B426 comprises an audio speaker supported at the awning frame B12 of each of the outdoor shading devices B10 and operatively linked to the control unit B40 for delivering audible sound to the outdoor shading device B10 when the sound module B426 is activated. It is worth mentioning that the light module B425 and the sound module B426 are preferably activated by the control unit B40 when the respective outdoor shading device B10 is folded at its unfolded position. Once the outdoor shading device B10 is folded at its folded position, i.e. the outdoor shading device B10 is not in use, the light module B425 and the sound module B426 are deactivated by the central control unit B40.

It is appreciated that the environmental sensor device B42 may further comprise a voice activator B427 and a range detector B428. The voice activator B427 is mounted at the outdoor shading device B10 and is operatively linked to the central control unit B40, such that when the voice activator B427 detects an audio command, the light module B425 and the sound module B426 are activated for generating illumination and audio effect respectively.

The range detector B428 is preferably mounted at each of the outdoor shading devices B10 at the awning frame B12 and is operatively linked to the control unit B40 for detecting the presence of the user within an awing folding range of the respective outdoor shading device B10. Therefore, at the time the range detector B428 detects the presence of the user when the awning frame B12 is folded between the folded position and the unfolded position, the awning folding arrangement B31 will be automatically deactivated to stop the folding movement of the awning frame B12 for safety purpose.

As it is mentioned above, the user is able to select one of the preference settings at the control panel B41 to selectively operate the designated outdoor shading devices B10. The control unit B40 is selectively activated through the preference settings of the control panel B41 to activate the outdoor shading device B10 at the standby mode. At the standby mode, the outdoor shading device B10 will be self-adjusted in responsive to its own setting. For example, the motion detector B424 will be activated to determine whether the respective outdoor shading device B10 needs to be folded at its unfolded position. Once the outdoor shading device B10 is at its unfolded position, the light module B425 and the sound module B426 will be activated automatically. The sunlight detector B421, the GPS circuitry B422, and the wind detector B423 will be activated when the outdoor shading device B10 are folded at the unfolded position. Therefore, the control unit B40 will provide an intelligent control system to monitor and control the outdoor shading device B10.

According to the preferred embodiment of the present invention, the control unit B40 preferably comprises a remote controller provided for remotely controlling the outdoor shading device B10

In the preferred embodiment, the control unit B40 further comprises a wireless link B50 for wirelessly connecting the controllers B30 with the central control unit B40 in a wireless manner. The wireless link B50 comprises a first communication link B51 operatively linked to the controller B30, and a second communication link B52 operatively linked to the control unit B40 to wirelessly communicate with the first communication link B51, such that the control unit B40 activates the outdoor shading device B10 to control the operation of the outdoor shading devices B10 in a wireless manner. Alternatively, the second communication link B52 may be operatively and individually linked to each of the sensor devices B42 of the control unit B40.

Accordingly, the central control unit B40 is able to wirelessly transmit the wireless control signal to the controllers B30 for adjustably and automatically controlling the outdoor shading devices B10.

According to the preferred embodiment, the central control unit B40 further comprises a self-diagnosing circuitry B43 operatively linked to the controller B30 to perform a self-diagnosing test of each of the controller B30. Therefore, the control unit B40 can automatically determine when one of the outdoor shading devices B10 is malfunctioned.

It will be readily appreciated that outdoor shading device B10 may comprise a plurality of communication wires being pre-wired for electrically connecting each of the controllers B30 and the central control unit B40 to communicatively operate the outdoor shading devices B10 via the central control unit B40.

The control unit B40 may further comprises a remote transmitter B44 remotely and controllably communicating with second communication link B52 of the environmental sensor device B42 and/or first communication link B51 of the controller B30. In the preferred embodiment, the remote transmitter B44 has one or more signal channels B441 for selectively and respectively controlling each of the sensor devices B42 and/or controller B30. In other words, each of the signal channels B441 preferably has a predetermined frequency for communicating with each of the respective first and/or second communication links.

For example, the sunlight detector B421 and the wind detector B423 operatively linked to the respective second communication links B52 is able to be independently and remotely controlled by the remote transmitter B44. Therefore, when remote transmitter is switching to the signal channel B441 for being received by the second communication link B52 of the wind detector B423, the threshold of the shaking movement detected via the wind detector B423 is able to be manually and remotely set by the remote transmitter B44.

The remote transmitter B44 may also directly and operatively link to the controller B30 for movably controlling the movement of the outdoor shading device B10, such as electrically folding the awning frame B12 between the folded and unfolded positions or rotatably adjusting the orientation of the outdoor shading device B10 by controlling the angular joint B32. For instance, the remote transmitter B44 may have a "POWER" key for remotely activating the control unit B40 and its sensor devices B42 at the standby mode, as mentioned above or an "OFF" key for remotely deactivating the control unit B40 and controller B30 to fold the awning frame B12 at the folded position.

It is important that the remote transmitter B44 may be able to be programmed to selectively pair the rest blank signal channels B441 with one or more other sensor devices B44, such as pair up one of the blank signal channels B441 with the light module B425 for remotely controlling the illumination effect. A temperature detector of the sensor device B44 may further incorporate with the outdoor shading device B10 and operatively link to a heater (not shown in the Figs.) of the outdoor shading device B10, so that when the environment temperature is lower than a preset temperature threshold of the temperature detector, the temperature detector will transmit a signal to automatically turn on the heater for warm up the shading area under the shelter B13.

As will be readily appreciated that the remote transmitter B44 preferably employees a radio technology to wirelessly and remotely controlling the control unit B40 and/or the controller B30. In other words, the second communication link B52 of respective sensor detector B44, such as the wind detector B423 and the sunlight detector B421, may have a radio tech receiver of the second communication link B52 in order to receive the radio signal generated from the remote transmitter B44, so as to individually and remotely adjusting and controlling the sensor device B44.

Figure 13:
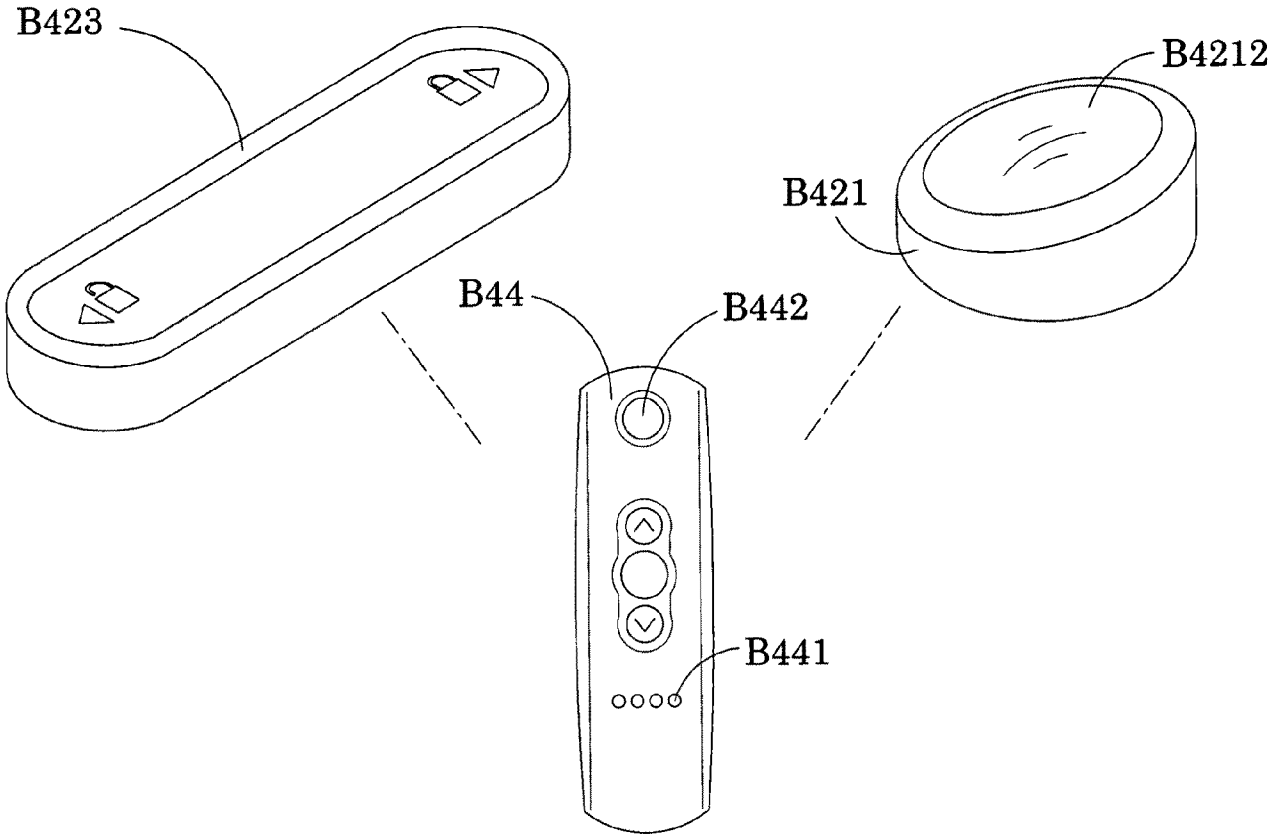
FIG. 13 is a schematic drawing of sunlight detector, wind detector, and a remote transmitter according to the above preferred embodiment of the present invention.

As best shown in FIG. 13 of the drawings, the remote transmitter B44 may further have a channel selection key B442 or the like for selectively switching to the desired signal channel B441 to remotely control the respective sensor device B44 or controller B30. It is appreciated that a control panel may be provided for controllably selecting the signal channel B441 and its related preference settings thereof.

Figure 14:
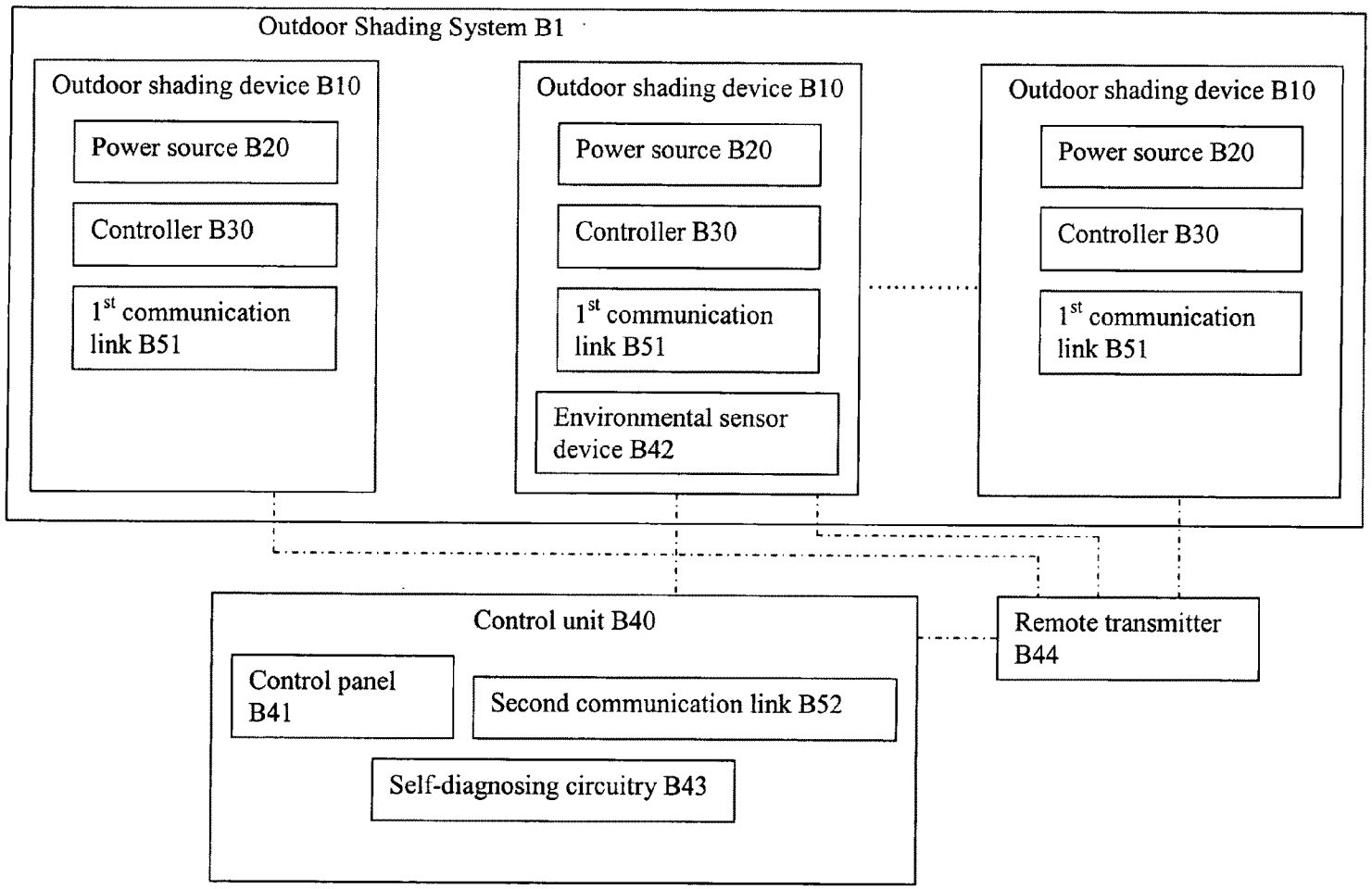
FIG. 14 is another block diagram of the intelligence outdoor shading arrangement according to the above preferred embodiment of the present invention, illustrating a plurality of shading device electrically and operatively connected to form a control network.

Referring to FIG. 14 of the drawings, the outdoor shading system B1 of the intelligence outdoor shading arrangement may comprise a group of outdoor shading devices B10 and at least one of the above mentioned control unit B40 to form a central control unit B40 operatively linked to each of the outdoor shading devices B10 for centrally controlling the outdoor shading devices B10 in a remotely manner, so that the user of the outdoor shading device B10 is able to remotely control the outdoor shading devices B10 while being time effectively.

In other words, the central control unit B40 is remotely linked to the controllers B30 to form a control network of the outdoor shading devices B10, wherein the central control unit B40 synchronously activates the controllers B30 to concurrently control the operation of the outdoor shading devices B10 in responsive to an environmental change of the control network.

Accordingly, the controllers B30 can be built-in with the outdoor shading devices B10 respectively that each of the outdoor shading devices B10 already has the controller B30 to control the operation. Alternatively, the controller B30 can be an external device added-on to each of the outdoor shading devices B10.

In other words, the central control unit B40 forms a central controller to concurrently operate all the outdoor shading devices B10 within the control network at the same time. Accordingly, the central control unit B40 comprises a control panel B41, having a plurality of preference settings, remotely linked to controllers B30 for synchronously activating the outdoor shading devices B10 in responsive to the preference settings.

Accordingly, the user is able to select one of the preference settings at the control panel B41 to selectively operate the designated outdoor shading devices B10. For example, when the control panel B41 is activated, such as a "POWER" key is activated, all the outdoor shading devices B10 are set at the standby mode. When an "ON" key is activated on the control panel B41, all the outdoor shading devices B10 will be automatically operated to move the awning frames B12 at the unfolded position. When an "OFF" key is activated on the control panel B41, all the outdoor shading devices B10 will be automatically operated to move the awning frames B12 at the folded position.

It will be appreciated that the above mentioned remote transmitter B44 may be remotely and operatively linked to the central control unit B40 for remotely and wirelessly control the central control unit B40, such as set up the preference settings and activating all of the outdoor shading devices B10 to the standby mode concurrently.

According to the preferred embodiment, the environmental sensor device B42 is supported at one of the outdoor shading devices B10 to form a primary outdoor shading device B10 of the control network. The rest of the outdoor shading devices become a plurality of slave outdoor shading devices B10, wherein when the primary outdoor shading device B10 is activated to be operated in responsive to the environmental change of the control network, the slave outdoor shading devices B10 are correspondingly operated in relation to the primary outdoor shading device B10. In other words, the user is able to pick one of the outdoor shading devices B10 to become the primary outdoor shading device B10 by locating the environmental sensor device B42 thereat to minimize the material cost of the environmental sensor device B42 incorporating with all the outdoor shading devices B10.

It is appreciated that each of the outdoor shading devices B10 can incorporate with its own environmental sensor device B42 (not shown in the drawings) such that each of the outdoor shading devices B10 can be self adjusted in responsive to its own environmental sensor device B42 while all the outdoor shading devices B10 can be centralized and controlled by the central control unit B40. In addition, the environmental sensor device B42 can be provided at an individual tower which is located away from the outdoor shading devices B10 for detecting the environmental change of the control network (not shown in the drawings) Therefore, the environmental sensor device B42 can precisely detect the environmental change to regulate the outdoor shading devices B10.

As a result, the primary outdoor shading device B10 is activated to be operated through the central control unit B40 in responsive to the environmental change of the control network, wherein the slave outdoor shading devices B10 are correspondingly operated in relation to the primary outdoor shading device B10.

It is worth mentioning that the central control unit B40 will optimize the operation of the outdoor shading devices B10 that when the shaking movement generated by the wind is higher than the preset threshold, all the outdoor shading devices B10 will be automatically folded at the folded position. Otherwise, the outdoor shading devices B10 will be automatically self-adjusted to minimize the wind loading at the awning frames B12.

The light module B425, sound module B426, and voice activator B427 are still preferred to be mounted at each of the outdoor shading devices B10 and is operatively linked to the central control unit B40, such that when the voice activator B427 detects an audio command, the light module B425 and the sound module B426 are activated for generating illumination and audio effect respectively.

The range detector B428 is preferably mounted at each of the outdoor shading devices B10 at the awning frame B12 and is operatively linked to the central control unit B40 for detecting the presence of the user within an awing folding range of the respective outdoor shading device B10.

As it is mentioned above, the user is able to select one of the preference settings at the control panel B41 and/or the remote transmitter B44 to selectively operate the designated outdoor shading devices B10. The central control unit B40 is selectively activated through the preference settings of the control panel B41 to activate all the outdoor shading devices B10 at the standby mode. At the standby mode, each of the outdoor shading devices B10 will be self-adjusted in responsive to its own setting.

For example, the motion detector B424 will be activated to determine whether the respective outdoor shading device B10 needs to be folded at its unfolded position. Once the outdoor shading device B10 is at its unfolded position, the light module B425 and the sound module B426 will be activated automatically. The sunlight detector B421, the GPS circuitry B422, and the wind detector B423 will be activated when the outdoor shading devices B10 are folded at the unfolded position. Therefore, the central control unit B40 will provide an intelligent control system to monitor and control the outdoor shading devices B10. It is appreciated that the central control unit B40 can concurrently control all the controllers B30 to fold and unfold the outdoor shading devices B10. Preferably, a timer module can be built-in the central control unit B40 to operate the outdoor shading devices B10 in a timely manner.

The wireless link B50 comprises a plurality of first communication links B51 operatively linked to the controllers B30 respectively, and the second communication link B52 operatively linked to the central control unit B40 to wirelessly communicate with the first communication links B51, such that the central control unit B40 synchronously activates the outdoor shading devices B10 to concurrently control the operation of the outdoor shading devices B10 in a wireless manner.

It is worth to mention that the first and second communication links B51, B52 can simplify the installation and configuration of the remote control system B20 by eliminating the pre-wiring process thereof.

According to the preferred embodiment, the self-diagnosing circuitry B43 is operatively linked to the controllers B30 to perform a self-diagnosing test of each of the controllers B30. Therefore, the central control unit B40 can automatically determine when one of the outdoor shading devices B10 is malfunctioned.

Therefore, the remote transmitter B44 may be able to activate the central control unit B40 to synchronizely activate the controllers B30, such that all the outdoor shading devices B10 within the control network will be activated at the standby mode. Preferably, the self-diagnosing test will run at each of the controllers B30 when the controller B30 is activated.

The user also can select the preference setting of the control panel B41 according to the user preference via the remote transmitter B44 in the remote control manner. Therefore, the user is able to unfold all the outdoor shading devices B10 concurrently by one touch of the control panel B41, such that all the outdoor shading devices B10 are ready to use. Alternatively, each of the outdoor shading devices B10 will be remained at the unfolded position until the respective outdoor shading device B10 is needed to be used.

The central control unit B40 can also set to the "auto" mode as mentioned above via the control panel B41 or remote transmitter B44, so that the central control unit B40 is able to synchronously activate the controllers B30 to concurrently control the operation of the outdoor shading devices B10 in responsive to the environmental changes of the control network.

The central control unit B40 could also be deactivated to concurrently switch off the controllers B30 through the control panel B41 or remote transmitter B44 in the wirelessly or remotely manner. Thus, all the outdoor shading devices B10 within the control network will be deactivated and will be folded back to the folded position.

Therefore, the shading system of the present invention allows the user to remotely and centrally control all the outdoor shading devices B10. The outdoor shading devices B10 are able to be simply activated, deactivated, set up the preference settings through the remote transmitter B44, so as to conveniently form the intelligence outdoor shading arrangements B10 and its control network.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An intelligence outdoor shading arrangement, comprising:

an outdoor shading system which comprises at least an outdoor shading device comprising a power source, a supporting frame, an awning frame suspendedly and movably supported by said supporting frame, and a shelter mounted to said awning frame to define a shading area thereunder;

an environmental sensor device, which is electrically linked to said power source for detecting an environmental change of said outdoor shading system with respect to said shading area, comprising a plurality of detectors, including a sunlight detector, a wind detector mounted on top front end edge of said awning frame, and a motion detector installed to said supporting frame;

a controller which is electrically linked to said environmental sensor device to control an operation of said supporting frame and said awning frame of said shading device, wherein when said controller receives a command signal from said environmental sensor device, at least one of said supporting frame and said awning frame is adjusted to regulate a position of said shading area thereof with respect to the environmental change of said shading system, wherein said controller is electrically linked to said sunlight detector, such that when said sunlight detector detects the light level of the environment exceeds a threshold, said shelter is folded at an unfolded position to maximize said shading area, and when said detected light level is below the threshold, said the shelter is folded at a folded position, wherein said controller is electrically linked to said wind detector, such that when said wind detector detects a movement of the awning frame generated by the wind, said shelter is adjusted to minimize a wind loading on said shelter, wherein said controller is electrically linked to said motion detector, such that when said motion detector detects the presence of a user within a detection area, said shelter is actuated to fold at said unfolded position; and a control unit, which comprises a control panel having a plurality of preference settings remotely linked to said controller and said sensor device for activating said outdoor shading device in responsive to said preference settings, and a remote transmitter wirelessly and remotely connected to said sensor device and said controller, wherein said remote transmitter has a plurality of preference settings, so that said remote transmitter is able to activate said outdoor shading device in responsive to said preference settings, wherein said remote transmitter comprises one or more signal channels wirelessly and remotely linked to said detectors of said sensor devices respectively, so as to manually adjust said thresholds of each of said detectors of said sensor device, wherein said sunlight detector is able to switch between an "auto" and "manual" mode, wherein when said "manual" mode is selected, said light level threshold is able to manually adjusted via one or more programming buttons, or via said remote transmitter.

2. The intelligence outdoor shading arrangement, as recited in claim 1, wherein said shading device further comprises a light module supported at said awning frame for illuminating said shading area, wherein said sunlight detector is further electrically linked to said light module, such that when said sunlight detector detects said light level of an environment of said shading device being lower than a preset light level threshold, said light module is activated for illumination.

3. The intelligence outdoor shading arrangement, as recited in claim 2, wherein said shading device further comprises a sound module which is electrically linked to said environmental sensor device and is supported at said awning frame for generating an audio effect within said shading area, wherein said environmental sensor device comprises a movement sensor detecting said awning frame at said unfolded and folded positions, such that when said movement sensor detects said awning frame at said unfolded position, said sound module is automatically activated for generating said audio effect, and when said movement sensor detects said awning frame at said folded position, said sound module is automatically deactivated.

4. The intelligence outdoor shading arrangement, as recited in claim 3, wherein said environmental sensor device further comprises a voice activator which is installed to said supporting frame and is electrically linked to said sound module, such that when said voice activator detects an audio command, said sound module is activated for generating said audio effect.

5. The intelligence outdoor shading arrangement, as recited in claim 4, wherein said environmental sensor device comprises a range detector which is installed to said awning frame and is electrically linked to said controller, such that when said range detector detects the presence of a user within an awning folding range at the time said awning frame is being folded to said unfolded position, said controller is automatically deactivated to stop said awning frame being folded to said unfolded position.

6. An intelligence outdoor shading arrangement, comprising:

an outdoor shading system which comprises at least an outdoor shading device comprising a power source, a supporting frame, an awning frame suspendedly and movably supported by said supporting frame, and a shelter mounted to said awning frame to define a shading area thereunder;

an environmental sensor device, which is electrically linked to said power source for detecting an environmental change of said outdoor shading system with respect to said shading area, wherein said environment sensor device comprises a motion detector installed to said supporting frame; and a controller which is electrically linked to said environmental sensor device to control an operation of said supporting frame and said awning frame of said shading device, wherein when said controller receives a command signal from said environmental sensor device, at least one of said supporting frame and said awning frame is adjusted to regulate a position of said shading area thereof with respect to the environmental change of said shading system, wherein said controller is electrically linked to said motion detector, such that when said motion detects a presence of a user within a detection area, said shelter is actuated to fold at an unfolded position.

7. The intelligence outdoor shading arrangement, as recited in claim 6, wherein said shading device further comprises a light module supported at said awning frame for illuminating said shading area, wherein a sunlight detector is further electrically linked to said light module, such that when said sunlight detector detects a light level of an environment of said shading device being lower than a preset light level threshold, said light module is activated for illumination.

8. The intelligence outdoor shading arrangement, as recited in claim 7, wherein said shading device further comprises a sound module which is electrically linked to said environmental sensor device and is supported at said awning frame for generating an audio effect within said shading area, wherein said environmental sensor device comprises a movement sensor detecting said awning frame at said unfolded and folded positions, such that when said movement sensor detects said awning frame at said unfolded position, said sound module is automatically activated for generating said audio effect, and when said movement sensor detects said awning frame at said folded position, said sound module is automatically deactivated.

9. The intelligence outdoor shading arrangement, as recited in claim 8, wherein said environmental sensor device further comprises a voice activator which is installed to said supporting frame and is electrically linked to said sound module, such that when said voice activator detects an audio command, said sound module is activated for generating said audio effect.

10. The intelligence outdoor shading arrangement, as recited in claim 9, wherein said environmental sensor device further comprises a range detector which is installed to said awning frame and is electrically linked to said controller, such that when said range detector detects the presence of the user within an awning folding range at the time said awning frame is being folded to said unfolded position, said controller is automatically deactivated to stop said awning frame being folded to said unfolded position.

11. The intelligence outdoor shading arrangement, as recited in claim 6, wherein said environmental sensor device further comprises a range detector which is installed to said awning frame and is electrically linked to said controller, such that when said range detector detects the presence of the user within an awning folding range at the time said awning frame is being folded to said unfolded position, said controller is automatically deactivated to stop said awning frame being folded to said unfolded position.

* * * * *